US010419850B2

(12) United States Patent
Turner et al.

(10) Patent No.: US 10,419,850 B2
(45) Date of Patent: Sep. 17, 2019

(54) DYNAMIC BOUNDARY PRESSURE ZONE MICROPHONE

(71) Applicant: TRIDENT ACOUSTICS, Santa Cruz, CA (US)

(72) Inventors: Warwick A. Turner, Santa Cruz, CA (US); Elias C. Turner, San Diego, CA (US)

(73) Assignee: TRIDENT ACOUSTICS, Santa Cruz, CA (US)

( * ) Notice: Subject to any disclaimer, the term of this patent is extended or adjusted under 35 U.S.C. 154(b) by 0 days.

(21) Appl. No.: 15/872,349

(22) Filed: Jan. 16, 2018

(65) Prior Publication Data

US 2018/0206031 A1 Jul. 19, 2018

Related U.S. Application Data

(60) Provisional application No. 62/499,140, filed on Jan. 18, 2017.

(51) Int. Cl.

| | |
|---|---|
| ***G10H 1/00*** | (2006.01) |
| ***H04R 1/46*** | (2006.01) |
| ***H04R 1/04*** | (2006.01) |
| *H04R 1/08* | (2006.01) |

(52) U.S. Cl.

CPC ..... *H04R 1/46* (2013.01); *H04R 1/04* (2013.01); *H04R 1/083* (2013.01)

(58) Field of Classification Search

CPC ... H04R 1/46; H04R 1/04; H04R 1/02; H04R 1/222; H04R 1/342; H04R 2420/09; G10H 3/146; G10H 3/183; G10H 3/186

USPC ... 381/118, 361, 365, 366, 368, 91, 92, 122; 84/726, 723

See application file for complete search history.

(56) References Cited

U.S. PATENT DOCUMENTS

| | | | | |
|---|---|---|---|---|
| 2,725,778 | A * | 12/1955 | Cronwell | G10D 1/10 381/118 |
| 3,496,297 | A * | 2/1970 | Brumberger | G10H 3/146 248/362 |
| 3,665,490 | A * | 5/1972 | Oskar | G10D 1/085 381/118 |
| 4,361,736 | A | 11/1982 | Long et al. | |
| 5,168,525 | A | 12/1992 | Müller | |
| 7,664,285 | B2 * | 2/2010 | Schmidt | G10K 11/004 381/361 |
| 8,989,399 | B2 * | 3/2015 | Baggs | H04R 3/007 381/111 |

(Continued)

*Primary Examiner* — Xu Mei

(74) *Attorney, Agent, or Firm* — Greenblum & Bernstein, P.L.C.

(57) ABSTRACT

A microphone assembly for a musical instrument. The microphone assembly includes a microphone housing having a longitudinal axis, a microphone capsule arranged at a first end of the microphone housing, and a baffle statically mounted to the first end of the microphone housing, such that the microphone capsule is arranged in the baffle. The baffle, when statically arranged in proximity to a dynamically moveable surface of the musical instrument, is operable to create a high sound pressure zone between a surface of the baffle and the dynamically moveable surface of the musical instrument. A diaphragm of the microphone capsule is approximately co-planar with at least a portion of the surface of the baffle surrounding the microphone capsule.

33 Claims, 18 Drawing Sheets

(56) References Cited

U.S. PATENT DOCUMENTS

| | | | | |
|---|---|---|---|---|
| 9,407,983 | B2 * | 8/2016 | Kumagai | H04R 1/342 |
| 9,438,994 | B2 * | 9/2016 | Linn | H04R 3/02 |
| 2008/0205669 | A1 * | 8/2008 | Michelet | H04R 1/406 381/118 |
| 2010/0260347 | A1 | 10/2010 | Baggs | |

* cited by examiner

DYNAMIC BOUNDARY PRESSURE ZONE MICROPHONE

CROSS REFERENCE TO RELATED APPLICATION

The present application claims the benefit of U.S. Provisional Application No. 62/499,140, filed Jan. 18, 2017, the contents of which are expressly incorporated herein by reference in its entirety.

BACKGROUND OF THE DISCLOSURE

1. Field of the Disclosure

This disclosure relates to a microphone (e.g., electroacoustic transducer), and more particularly to a dynamic boundary pressure zone microphone assembly for musical instruments and sound reproduction, in which a transducer mounted in a baffle is statically mountable in close proximity to a vibrating membrane, such as the head of a banjo, the top or back plate of a guitar, violin, viola, cello, bass, mandolin, drum, or piano, or any other musical instrument with a vibrating membrane as a sound producing element, e.g., a primary sound producing element.

2. Description of the Related Art

A major problem with the current way in which microphones are used with musical instruments is that at the distances the microphones are commonly arranged at relative to a sound source (e.g., 3" to 12" from a sound source), acoustic feedback is a constant problem. Also with the use of some microphones, there may be a natural bass boost as the musician brings an instrument closer to the microphone (what is called the "proximity effect"). These two issues can severely limit the loudness one can achieve with a microphone on stage.

Audio feedback (also known as acoustic feedback, simply as feedback, or the Larsen effect) is a special kind of positive loop gain which occurs when a sound loop exists between an audio input (for example, a microphone or guitar pickup) and an audio output (for example, an power amplified loudspeaker). In this example, a signal received by the microphone is amplified and passed out of the loudspeaker. The sound from the loudspeaker can then be received by the microphone again, amplified further, and then passed out through the loudspeaker again. The frequency of the resulting sound is dependent upon resonance frequencies in the microphone, amplifier, and loudspeaker, the acoustics of the room, the directional pick-up and/or emission patterns of the microphone and loudspeaker, and/or the distance between them.

Feedback is almost always considered undesirable when it occurs with a singer's or public speaker's microphone at an event using a sound reinforcement system or PA system. Audio engineers may use highly directional cardioid microphones (e.g., super cardioid and hyper cardioid microphones) and various electronic devices, such as equalizers and, since the 1990s, automatic feedback detection devices to prevent these unwanted squeals or screeching sounds, which can detract from the audience's enjoyment of a performance.

For example, a conventional microphone placed on, or a few inches above, a hard boundary surface will pick up the desired direct sound as well as delayed sound reflecting off the boundary surface. The direct and delayed reflected sounds will combine at the microphone to create comb filtering, with constructive and destructive interference causing undesirable peaks and valleys in the frequency response.

The delay time of the reflection for most microphones may be in the range of 0.1 to 1 milliseconds, corresponding to cancellation frequencies of a few kilohertz and octave multiples. Since these frequencies are audible, the cancellation effects are also audible and are said to undesirably "color" the resulting audio signals.

With a pressure zone (or boundary) microphone, however, by placing the diaphragm of the microphone capsule parallel to and facing the plate boundary provided by the microphone package, the reflected sound delay is reduced, and the resulting comb filter interference frequencies are high enough that they are outside the audible range. Thus, a main advantage of boundary microphones is the elimination of interference from reflected sound waves. As explained, a normal microphone will pick up sound waves from the primary source and also any reverberations, which can result in unnatural sound reproduction. In the pressure zone microphone, however, sound waves are in phase and there is no (or little) interference.

Conventional boundary microphones, however, are set at a boundary of a surface of a room or a surface in the room for pickup of much more distant sound sources (using the wall as the baffle). For example, conventional boundary microphones work best when placed against a hard, flat surface at least one meter square; for example, a tabletop or wall. Additionally, some boundary microphones use a large reflective baffle to simulate a wall. In some cases, large reflective baffles are built into the microphones, and in other cases, the boundary microphones are used on conference tables (which act as the baffle). While some pressure zone microphones are used for micing instruments, these treat the whole instrument as the "room."

Therefore, there is a need for an improved pressure zone (or boundary) microphone that may be used with an individual instrument.

SUMMARY OF THE EMBODIMENTS OF THE DISCLOSURE

This disclosure relates to a microphone (e.g., electroacoustic transducer), and more particularly to a dynamic boundary pressure zone microphone assembly for musical instruments and sound reproduction, in which a transducer mounted in a baffle is statically mountable in close proximity to a vibrating membrane, such as the head of a banjo, the top or back plate of a guitar, violin, viola, cello, bass, mandolin, drum, or piano, or any other musical instrument with a vibrating membrane as a sound producing element, e.g., a primary sound producing element.

Aspects of the present disclosure are directed to a microphone assembly for a musical instrument. The microphone assembly comprises a microphone housing having a longitudinal axis, a microphone capsule arranged at a first end of the microphone housing, and a baffle statically mounted to the first end of the microphone housing, such that the microphone capsule is arranged in the baffle. The baffle, when statically arranged in proximity to a dynamically moveable surface of the musical instrument, is operable to create a high sound pressure zone between a surface of the baffle and the dynamically moveable surface of the musical instrument. A diaphragm of the microphone capsule is approximately co-planar with at least a portion of the surface of the baffle surrounding the microphone capsule.

In further embodiments, the microphone housing comprises a tube structure.

In additional embodiments, wherein the surface of the baffle has an asymmetrical shape.

In some embodiments, the surface of the baffle has a nautilus shape.

In some embodiments, the baffle has a constantly changing distance from the center of the microphone capsule arranged in the baffle to an outer edge of the baffle.

In embodiments, at least a portion of the surface of the baffle is approximately perpendicular to the longitudinal axis.

In further embodiments, the baffle is planar.

In additional embodiments, the baffle surface is planar.

In embodiments, the baffle is contoured or curved.

In yet further embodiments, the baffle surface is contoured or curved.

In some embodiments, the surface of the baffle has a symmetrical shape.

In further embodiments, the microphone assembly further comprises a housing, wherein the microphone housing is adjustably securable to the housing so that a distance between the surface of the baffle and the dynamically moveable surface of the musical instrument may be adjusted, and the distance between the surface of the baffle and a rest-position of the dynamically moveable surface of the musical instrument may be fixed.

In certain embodiments, the one end of the microphone housing projects directly from the housing.

In some embodiments, the microphone housing is connected to the housing via a support arm.

In embodiments, the housing comprises a fastening assembly structured and arranged for securely and statically mounting the housing in or on the musical instrument, such that the baffle is statically arranged with respect to the dynamically moveable surface of the musical instrument.

In further embodiments, the microphone assembly further comprises a gasket arranged along an edge of the baffle to provide greater sonic isolation is the high sound pressure zone.

In embodiments, the microphone assembly further comprises a surface treatment on the baffle, wherein the surface treatment comprises at least one of felt, cork, rubber, or foam.

In embodiments, the baffle is frictionally-engaged with the microphone housing such that the baffle is rotationally adjustable on the microphone housing.

Additional aspects of the disclosure are directed to a microphone assembly for a musical instrument. The microphone assembly comprises a microphone housing having a longitudinal axis, a microphone capsule arranged at a first end of the microphone housing, a baffle statically mounted on the first end of the microphone housing, such that the microphone capsule is arranged in the baffle, and a housing, wherein the microphone housing is adjustably securable to the housing. The baffle, when statically arranged in proximity to a dynamically moveable surface of the musical instrument, is operable to create a high sound pressure zone between a surface of the baffle and the dynamically moveable surface of the musical instrument. The surface of the baffle has an asymmetrical shape. A diaphragm of the microphone capsule is approximately co-planar with at least a portion of the surface of the baffle surrounding the microphone capsule. The portion of the surface of the baffle is approximately perpendicular to the longitudinal axis. A distance between the surface of the baffle and the dynamically moveable surface of the musical instrument may be adjusted, and the distance between the surface of the baffle and rest position of the dynamically moveable surface of the musical instrument may be fixed.

In further embodiments, the asymmetrical shape comprises a nautilus shape.

Additional aspects of the disclosure are directed to a microphone assembly arranged in or on a musical instrument. The microphone assembly comprises a microphone housing, a microphone capsule arranged at a first end of the microphone housing, and a baffle statically mounted to the first end of the microphone housing, such that the microphone capsule is arranged in the baffle. The baffle is statically arranged in proximity to a dynamically moveable surface of the musical instrument, and is operable to create a high sound pressure zone between a surface of the baffle and the dynamically moveable surface of the musical instrument. A diaphragm of the microphone capsule is approximately co-planar with at least a portion of the surface of the baffle surrounding the microphone capsule.

In embodiments, the surface of the baffle is approximately parallel to the dynamically moveable surface of the musical instrument.

In additional embodiments, a distance between the surface of the baffle and the dynamically moveable surface of the musical instrument is adjustable.

In embodiments, a distance between the surface of the baffle and rest position of the dynamically moveable surface of the musical instrument is set between ⅛" and ½".

In yet further embodiments, the asymmetrical shape comprises a nautilus shape.

In further embodiments, the musical instrument is one of: a banjo, a guitar, a violin, a viola, a cello, a mandolin-family instrument, an upright bass, a piano, or a drum.

In further embodiments, the microphone assembly is statically arranged internally within the musical instrument.

In other embodiments, the microphone assembly is statically arranged adjacent an external surface of the musical instrument.

In further embodiments, a distance d between the surface of the baffle and a rest-position of the dynamically moveable surface of the musical instrument is $d \leq \frac{1}{2}(R_{min}+R_{max})/2))$, wherein $R_{min}$ is a minimum radial distance of the baffle and $R_{max}$ is a maximum radial distance of the baffle.

In other embodiments, the musical instrument comprises a soundboard for sound production.

BRIEF DESCRIPTION OF THE DRAWINGS

The novel features which are characteristic of the disclosure, both as to structure and method of operation thereof, together with further aims and advantages thereof, will be understood from the following description, considered in connection with the accompanying drawings, in which embodiments of the disclosure are illustrated by way of example. It is to be expressly understood, however, that the drawings are for the purpose of illustration and description only, and they are not intended as a definition of the limits of the disclosure. For a more complete understanding of the disclosure, as well as other aims and further features thereof, reference may be had to the following detailed description of the embodiments of the disclosure in conjunction with the following exemplary and non-limiting drawings wherein.

Figure 1:
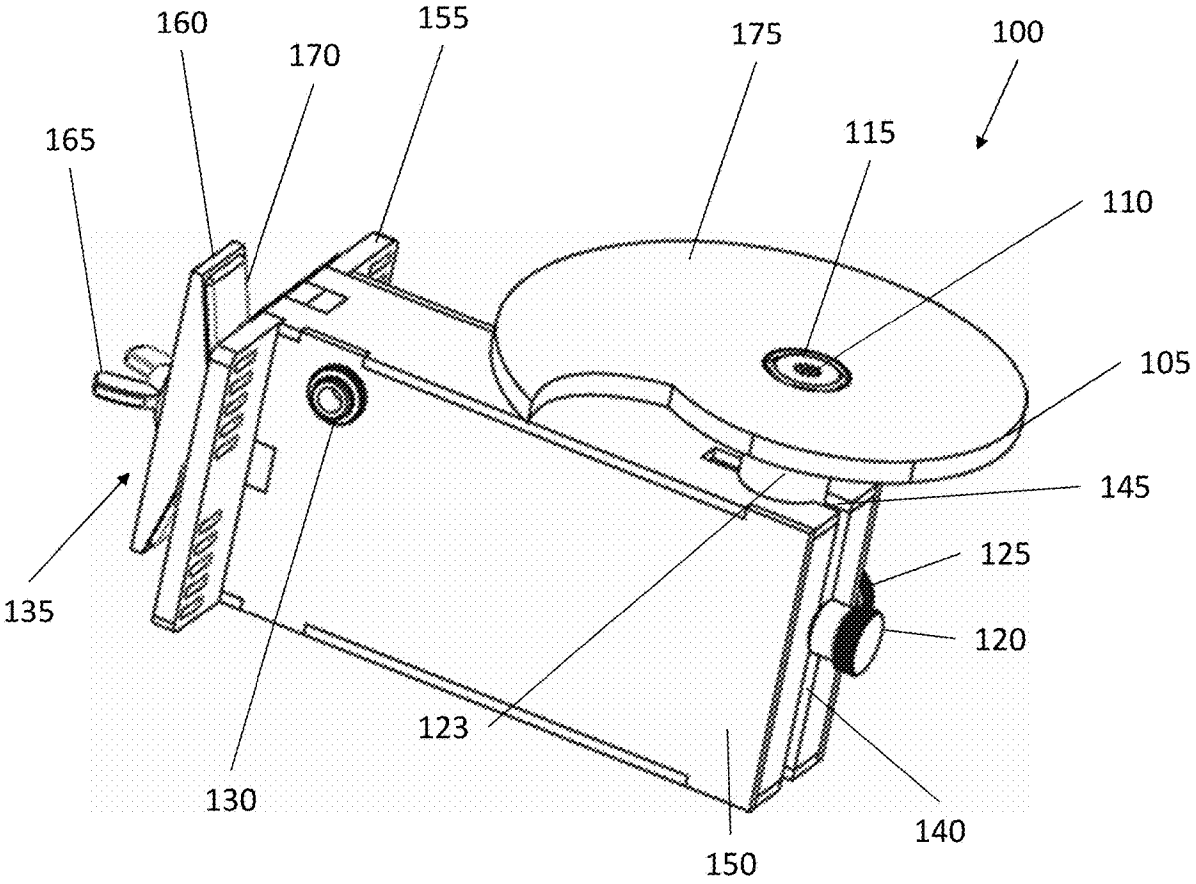
FIG. 1 is an upper perspective view of an exemplary dynamic boundary pressure zone microphone assembly in accordance with aspects of the disclosure.

Reference numbers refer to the same or equivalent parts of the present disclosure throughout the various figures of the drawings.

DETAILED DESCRIPTION OF THE EMBODIMENTS OF THE DISCLOSURE

In the following description, the various embodiments of the present disclosure will be described with respect to the enclosed drawings. As required, detailed embodiments of the embodiments of the present disclosure are discussed herein; however, it is to be understood that the disclosed embodiments are merely exemplary of the embodiments of the disclosure that may be embodied in various and alternative forms. The figures are not necessarily to scale and some features may be exaggerated or minimized to show details of particular components. Therefore, specific structural and functional details disclosed herein are not to be interpreted as limiting, but merely as a representative basis for teaching one skilled in the art to variously employ the embodiments of the present disclosure.

The particulars shown herein are by way of example and for purposes of illustrative discussion of the embodiments of the present disclosure only and are presented in the cause of providing what is believed to be the most useful and readily understood description of the principles and conceptual aspects of the present disclosure. In this regard, no attempt is made to show structural details of the present disclosure in more detail than is necessary for the fundamental understanding of the present disclosure, such that the description, taken with the drawings, making apparent to those skilled in the art how the forms of the present disclosure may be embodied in practice.

As used herein, the singular forms "a," "an," and "the" include the plural reference unless the context clearly dictates otherwise. For example, reference to "a magnetic material" would also mean that mixtures of one or more magnetic materials can be present unless specifically excluded.

Except where otherwise indicated, all numbers expressing quantities used in the specification and claims are to be understood as being modified in all instances by the term "about." Accordingly, unless indicated to the contrary, the numerical parameters set forth in the specification and claims are approximations that may vary depending upon the desired properties sought to be obtained by embodiments of the present disclosure. At the very least, and not to be considered as an attempt to limit the application of the doctrine of equivalents to the scope of the claims, each numerical parameter should be construed in light of the number of significant digits and ordinary rounding conventions.

Additionally, the recitation of numerical ranges within this specification is considered to be a disclosure of all numerical values and ranges within that range (unless otherwise explicitly indicated). For example, if a range is from about 1 to about 50, it is deemed to include, for example, 1, 7, 34, 46.1, 23.7, or any other value or range within the range.

As used herein, the indefinite article "a" indicates one as well as more than one and does not necessarily limit its referent noun to the singular.

As used herein, the terms "about" and "approximately" indicate that the amount or value in question may be the specific value designated or some other value in its neighborhood. Generally, the terms "about" and "approximately" denoting a certain value is intended to denote a range within ±5% of the value. As one example, the phrase "about 100" denotes a range of 100±5, i.e. the range from 95 to 105. Generally, when the terms "about" and "approximately" are used, it can be expected that similar results or effects according to the disclosure can be obtained within a range of ±5% of the indicated value.

As used herein, the term "and/or" indicates that either all or only one of the elements of said group may be present. For example, "A and/or B" shall mean "only A, or only B, or both A and B". In the case of "only A", the term also covers the possibility that B is absent, i.e. "only A, but not B".

The term "substantially parallel" refers to deviating less than 20° from parallel alignment and the term "substantially perpendicular" refers to deviating less than 20° from perpendicular alignment. The term "parallel" refers to deviating less than 5° from mathematically exact parallel alignment. Similarly "perpendicular" refers to deviating less than 5° from mathematically exact perpendicular alignment.

The term "at least partially" is intended to denote that the following property is fulfilled to a certain extent or completely. The terms "substantially" and "essentially" are used to denote that the following feature, property or parameter is either completely (entirely) realized or satisfied or to a major degree that does not adversely affect the intended result.

The term "comprising" as used herein is intended to be non-exclusive and open-ended. Thus, for instance a composition comprising a compound A may include other compounds besides A. However, the term "comprising" also covers the more restrictive meanings of "consisting essentially of" and "consisting of", so that for instance "a composition comprising a compound A" may also (essentially) consist of the compound A.

The various embodiments disclosed herein can be used separately and in various combinations unless specifically stated to the contrary.

FIG. 1 is an upper perspective view of an exemplary pressure zone microphone assembly 100 in accordance with aspects of the disclosure. As described herein, the microphone assembly 100 is structured for static mounting in (or on) a musical instrument having a moving diaphragm (such as, banjos, mandolins, violin family of instruments, guitars, pianos, etc.), such that the microphone is statically mounted close to a vibrating surface of the musical instrument. In embodiments, the closely-mounted baffle microphone includes a baffle mounted closely on the plane of the microphone diaphragm. In accordance with aspects of the disclosure, this close proximity of the baffled microphone to the vibrating diaphragm creates a high sound pressure level zone there between that is reasonably isolated (e.g., sonically) from farther distances, enhancing the signal-to-noise ratio and enhancing the signal-to-ambient sound ratio within the high sound pressure level zone.

As shown in FIG. 1, the exemplary pressure zone microphone assembly 100 includes a microphone housing (e.g., tube) 123 in which a microphone capsule 115 is arranged (with a sound inlet 110). In embodiments, the microphone capsule 115 can be of any reception pattern (including, e.g., cardioid, super cardioid, omni directional, etc.). In a non-limiting and exemplary embodiment, the microphone capsule 115 may be an electret microphone capsule. In a non-limiting and exemplary embodiment, the microphone capsule 115 may be a noise-canceling microphone. In an exemplary embodiment, the microphone housing 123 may comprise a metal (e.g., brass) tube sized to accommodate the microphone capsule 115.

As additionally shown in FIG. 1, the dynamic boundary pressure zone microphone assembly 100 includes a baffle 105 that is statically mounted to the housing 150, for example, via the microphone housing 123. In embodiments, the baffle 105 may comprise wood (e.g., laminated wood), metal, plastic, composite, or other suitable material, and any combinations thereof. Additionally, in embodiments, the baffle 105 may include one or more surface treatments, including, for example, covering the baffle 105 with felt, cork, rubber, foams, or other acoustically impactful materials. In accordance with aspects of the disclosure, in embodiments the baffle 105 is only held on microphone housing 123 by frictional engagement, so the baffle 105 may be turned or pivoted on the microphone housing 123, e.g., fairly easily.

As shown in FIG. 1 and described further herein, in embodiments, the baffle 105 may be asymmetrical in shape (e.g., as viewed from above). In accordance with aspects of the disclosure, by utilizing an asymmetrical shape, the microphone 115 does not favor any particular frequency, and reduces acoustic resonant frequencies. As shown with the example of FIG. 1, in embodiments, in accordance with aspects of the disclosure, the perimeter of the baffle 105 may have a nautilus shape. In accordance with aspects of the disclosure, the nautilus shape, in which the distance from the center of the microphone capsule to the edge of the baffle plate is constantly changing, is beneficial in not favoring any particular frequency, and reducing acoustic resonant frequencies. In other contemplated embodiments, the baffle may have a symmetrical shape.

Additionally, as shown in FIG. 1 and described further herein, in embodiments, the baffle 105 may be a plate (e.g., substantially flat or planar with a thickness). Thus, as shown in FIG. 1, in embodiments, the baffle 105 has an "upper" (or facing) surface 175 that is planar. It should be understood, however, that the disclosure contemplates embodiments that include non-planar baffle plates, for example, as discussed herein. Thus, while sometime described as a "plate," it should be understood that, in embodiments, the baffle (and/or a surface of the baffle) may be non-planar, for example, depending on a profile of a dynamic boundary of the musical instrument to which the microphone assembly 100 is attached, as explained herein.

The pressure zone microphone assembly 100 also includes a housing 150 in which the microphone housing 123 is arranged to project from. In embodiments, the housing 150 may comprise wood, plastic, metal, composite, or other suitable material, and any combinations thereof. In embodiments, the microphone housing 123 may comprise metal, plastic, composite, or other suitable material, and any combinations thereof. In some embodiments, the housing 150 may be sized to accommodate, for example, a battery and electronic components (e.g., connection wiring and jack components). In other contemplated embodiments, the housing 150 may be sized to accommodate the adjustably-positionable microphone housing 123 with the attached microphone capsule 115 and baffle 105, with a battery and electronic components arranged in a separate housing (e.g., an external box).

In embodiments, the housing 150 may also include adjustment slots 140 and 145, and knobs (e.g., thumb screws) 120 and 125. In accordance with aspects of the disclosure, the knob 120 may be loosened to adjust the height of the microphone housing 123 to so as to adjust the height and of the baffle 105 and microphone 115 relative to the housing 150. For example, adjustments to distance to the dynamic boundary, for example, a banjo head, are done by loosening thumb screw 120 and sliding the tube farther into or out of the housing 150, then tightening 120 to lock the position.

As such, the knob 120 may then be re-tightened (e.g., with the knob 120 at a new position in the adjustment slot 140) to fixedly (or statically) position the baffle 105 and microphone capsule 115. That is, while the baffle plate 105 is described as statically mounted to the housing 150, it should be understood that the position of the microphone housing 123 in the housing 150 (and thus the baffle 105 and microphone capsule 115) are adjustable relative to the housing 150, to allow a user to position (or re-position) the placement of the baffle 105 and microphone 115 (e.g., to adjust and fixedly or statically set a distance between the "upper" (or facing) surface 175 of the baffle and the dynamic boundary), as explained below. Once locked in position, the microphone housing 123 does not rotate. In accordance with aspects of the disclosure, one purpose of knob 120 is to lock the orientation of the microphone housing 123 to the housing 150 to prevent the wires from getting pinched or twisted. Knob 125 may be loosened to open the housing 150. For example, knob 125 can be removed or loosened to take the lid off the housing for battery and electronics access.

In embodiments, adjustments in microphone location on the surface of the diaphragm may be done by changing the mounting position of the entire housing 150. On banjos for example, this may be done by sliding the housing 150 along the coordinator or dowel rods that run through the center of the banjo, roughly parallel to the head.

In accordance with aspects of the disclosure, the baffle 105 can also be rotated around the axis of the microphone housing 123 (e.g., tube) to cover different sections of the dynamic boundary. This allows the actual microphone capsule 115 to stay in one position while the pickup area of the pressure zone in changed. In accordance with aspects of the disclosure, this is one of the advantages of the nautilus shape baffle 105. For example, the baffle 105 may be oriented so that it extends to cover more area towards the edge/center of the head of a banjo, emphasizing more high/low frequencies and harmonics. In accordance with aspects of the disclosure, the asymmetrical baffle can be adjusted (e.g., rotated) to vary what area of the instrument (dynamic boundary) is being picked up. For example, rotating the baffle 105 around the microphone housing 123 can cover more of the center of the instrument (bringing out lower frequencies) or the edge (bringing out higher frequencies). It is also important on the externally-mounted systems for violin and mandolin, as the extent that the sound holes are (or are not) covered by the baffle is hugely impactful on the response of the dynamic boundary pressure zone microphone. For example, the extent that the sound holes are (or are not) covered controls how much the resonance of the instrument's air-chamber is coupled to the pressure zone.

It is also important on the externally-mounted systems for violin and mandolin, as the extent that the sound holes are (or are not) covered by the baffle is hugely impactful on the response of the dynamic boundary pressure zone microphone. For example, this ability to reorient or adjust the baffle 105 on the microphone housing 123 particularly impactful on the violin and mandolin versions, where placement of the baffle over the sound-holes may be critical to achieving "natural" tone, controlling coupling the resonance of the instrument's air chamber to the pressure zone. For example, the extent that the sound holes are (or are not) covered controls how much the resonance of the instrument's air-chamber is coupled to the pressure zone.

As shown in the exemplary embodiment of FIG. 1, the housing 150 also includes a connection jack 130 (e.g., a ¼" jack, XLR jack, or a 3.5 mm jack, for example) for connecting a cable to transmit the sounds captured by the microphone 115 (e.g., to an amplifier or PA system). Additionally, in embodiments, the housing 150 may include a fastening assembly 135 structured and arranged for fastening the pressure zone microphone assembly 100 in or on a musical instrument. In embodiments, the exemplary fastening assembly 135 may include a threaded screw (not shown), a nut 165 fasteneable thereon, and a clamp plate 160 structured and arranged to interact with a back plate 155 of the housing 150 so as to be fixedly clamped to a portion of a musical instrument. In embodiments, the clamp plate 160 may include a compressible cushioning material 170 to protect the attachment surface(s) of the musical instrument and/or reduce any vibrations. Additionally, while not shown in FIG. 1, the disclosure contemplates that a compressible cushioning material may also (or alternatively) be arranged on the back plate 155.

While FIG. 1 illustrates an exemplary fastening assembly 135, it should be understood that the pressure zone microphone assembly 100 may be statically or rigidly attached to a particular instrument using a different fastening assembly. For example, instead of using a clamping assembly, which is operable to clamp a portion of the musical instrument, the disclosure contemplates that a pressure zone microphone assembly 100 could be attached to a musical instrument via screws attaching to the musical instrument, for example, via holes in the back plate 155 of the housing 150. With another contemplated embodiment, the dynamic boundary pressure zone microphone assembly 100 may be attached to a musical instrument via adhesive arranged between the back plate 155 and a surface of the musical instrument. In a further contemplated embodiment, the dynamic boundary pressure zone microphone assembly 100 may be attached to a musical instrument via a non-rigid, but static configuration, e.g., shock mounting via elastic suspension in or on the musical instrument.

As shown in FIG. 1, in accordance with aspects of the disclosure, the sound inlet 110 of the microphone capsule 115 (or in embodiments, the diaphragm of the microphone capsule 115) is approximately flush with the upper surface 175 of the baffle 105. Thus, as shown in FIG. 1, the microphone capsule 115 is arranged at an end of the microphone housing 123 so as to be approximately flush with the baffle 105. With an exemplary and non-limiting embodiment, adhesive heat-shrink material may be arranged around the microphone capsule 115 and press-fit it into the microphone housing 123. In accordance with aspects of the disclosure, the heat-shrink material electrically isolates microphone capsule 115 and keeps microphone capsule 115 firmly in place in the microphone housing 123 without needing to utilize glues or sealants. In other contemplated embodiments, however, glues and/or sealants may be utilized to secure the microphone capsule 115 in the microphone housing 123.

Figure 2:
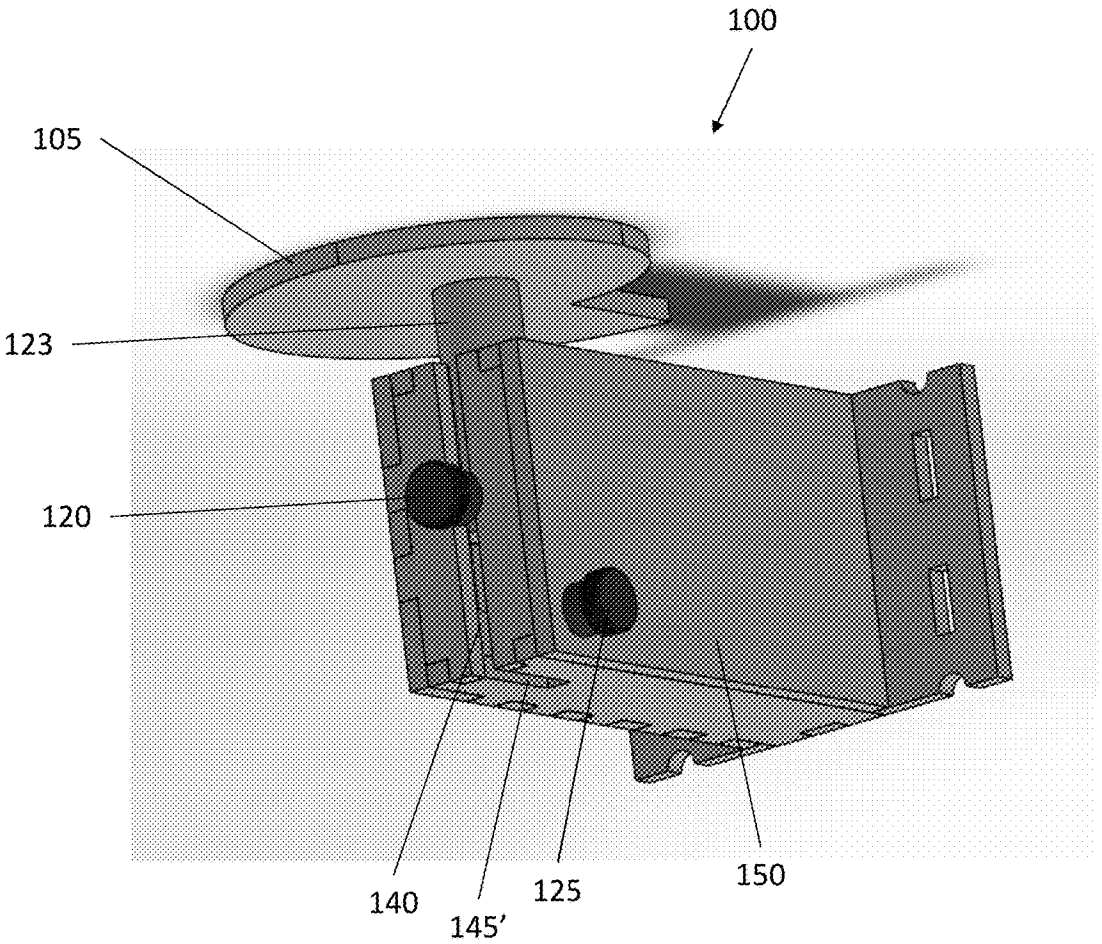
FIG. 2 is a lower perspective view of an exemplary dynamic boundary pressure zone microphone assembly in accordance with aspects of the disclosure.

FIG. 2 is a lower perspective view of a pressure zone microphone assembly 100 in accordance with aspects of the disclosure. As shown in FIG. 2, the pressure zone microphone assembly 100 includes a microphone housing 123 and a housing 150 in which the microphone housing 123 is arranged to project from. As additionally shown in FIG. 2, the pressure zone microphone assembly 100 includes a baffle 105 that is statically mounted to the housing 150 via the microphone housing 123. The housing 150 also includes slots 140 and 145' and adjustment knobs 120 and 125, which, as explained above, may be loosened to adjust the height and/or lateral position of the microphone housing 123, and thus the baffle 105 and microphone 115 that are statically mounted to the microphone housing 123, and tightened to fixedly (or statically) position the baffle 105 and microphone 115. The housing 150 also includes the back plate 155 which may be used to attach the microphone assembly 100 in (or on) a musical instrument.

Figure 3A:
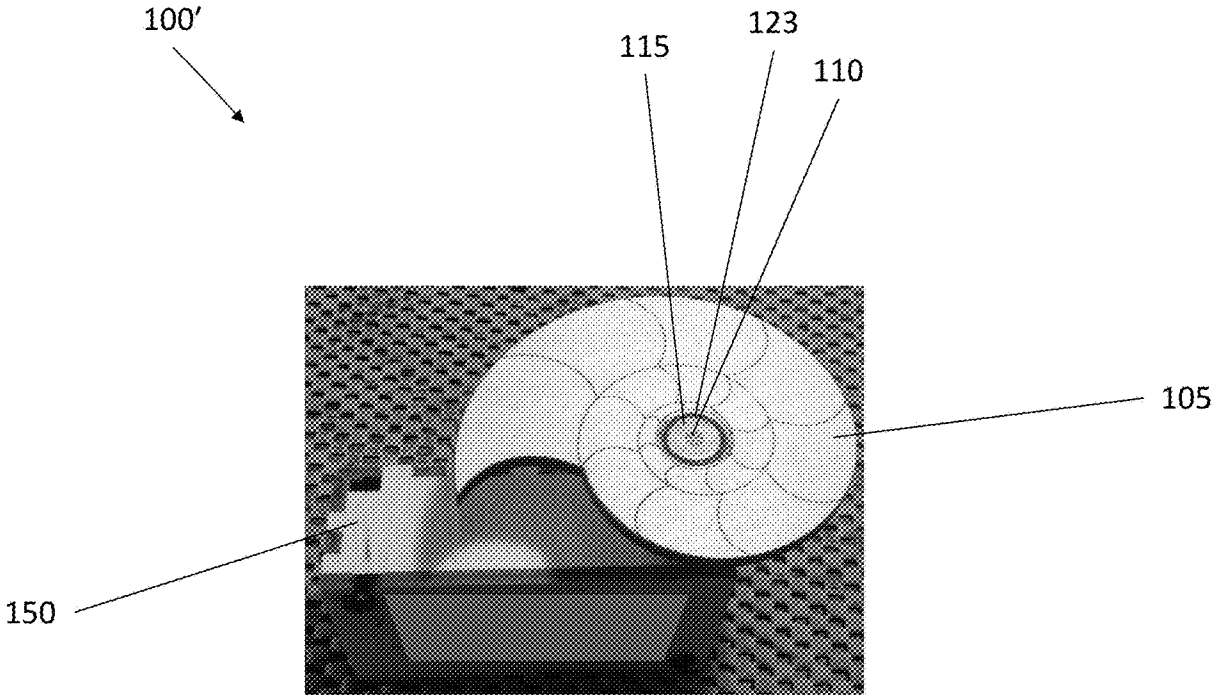
FIG. 3A is a upper view photograph of an exemplary dynamic boundary pressure zone microphone assembly in accordance with aspects of the disclosure.

FIG. 3A is an upper view photograph of an exemplary pressure zone microphone assembly 100' in accordance with aspects of the disclosure. As shown in FIG. 3, the pressure zone microphone assembly 100' includes a microphone capsule 115 with a sound inlet 110 arranged in a microphone housing 123, and a housing 150 in which the microphone housing 123 is arranged to project from. As additionally shown in FIG. 3A, the pressure zone microphone assembly 100' includes a baffle 105 that is statically and fixedly mounted to the microphone housing 123, which in turn in is statically (and adjustably) mounted to the housing 150. In embodiments, the baffle 105 may be statically mounted to the microphone housing 123 using an adhesive, for example. In other contemplated embodiments, the baffle 105 may be statically and fixedly mounted to the microphone housing 123 using welds. In contrast to the exemplary embodiment shown in FIG. 1, with this exemplary pressure zone microphone assembly 100', the housing 150 does not include a back plate fastening assembly.

Additionally, as shown in FIG. 3A, in embodiments, the baffle 105 may have a modified spiral or nautilus shape, in which the distance from the center of the microphone capsule 115 to the edge of the baffle 105 is constantly changing. In accordance with aspects of the invention, by utilizing such an asymmetrical shape, the microphone to edge distance is a constantly changing wavelength, such that the microphone does not favor any particular frequency. Additionally, utilizing a baffle with an asymmetrical shape may reduce acoustic resonant frequencies.

Figure 3B:
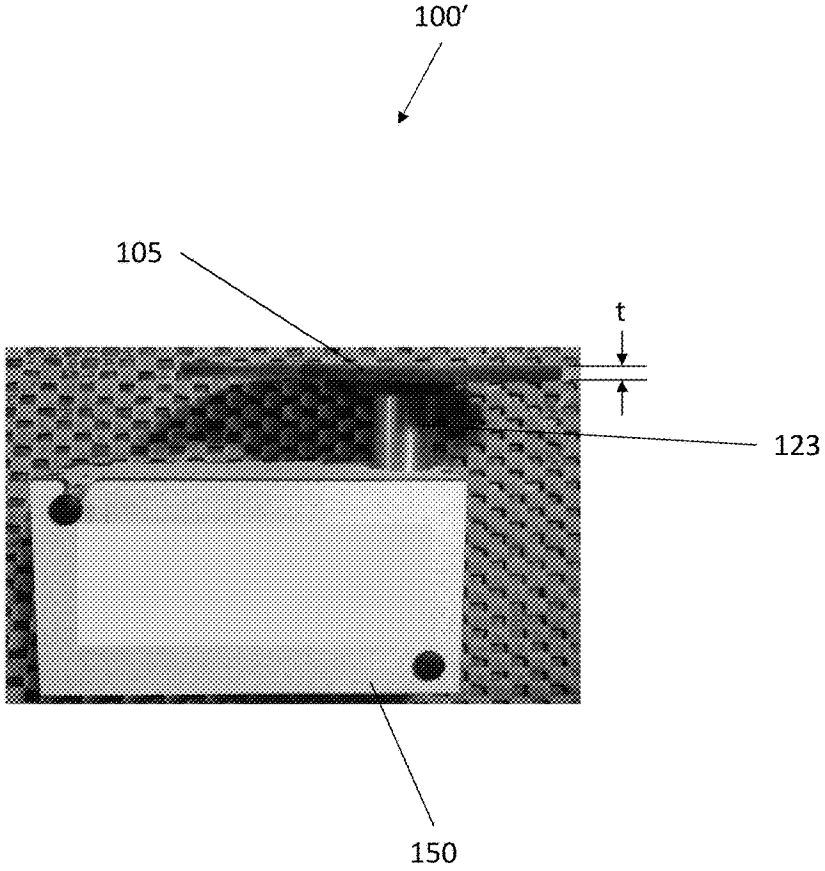
FIG. 3B is a side view photograph of an exemplary dynamic boundary pressure zone microphone assembly in accordance with aspects of the disclosure.

FIG. 3B is a side view photograph of an exemplary pressure zone microphone assembly 100' in accordance with aspects of the disclosure. As shown in FIG. 3B, the exemplary pressure zone microphone assembly 100' includes a microphone capsule (not shown) arranged in a microphone housing 123, and a housing 150 in which the microphone housing 123 is arranged to project from. As additionally shown in FIG. 3B, the pressure zone microphone assembly 100 includes a baffle 105 that is statically mounted (e.g., via a frictional engagement that allows for rotational adjustment) to the microphone housing 123, which in turn in is statically (and adjustably) mounted to the housing 150. As shown in FIG. 3B, in some embodiments, the baffle 105 is planar with a uniform or constant thickness t, and includes a facing surface, which is positionable to face a dynamic boundary of a musical instrument. In an exemplary and non-limiting embodiment, the thickness t may be approximately ⅛", with other thicknesses contemplated by the disclosure. It should be understood, however, that the physical size of the baffle (including thickness) may be altered to suit particular applications. For example, a relatively larger baffle may be utilized for a piano or bass, whereas a relatively smaller baffle may be utilized for a violin.

Figure 4B:
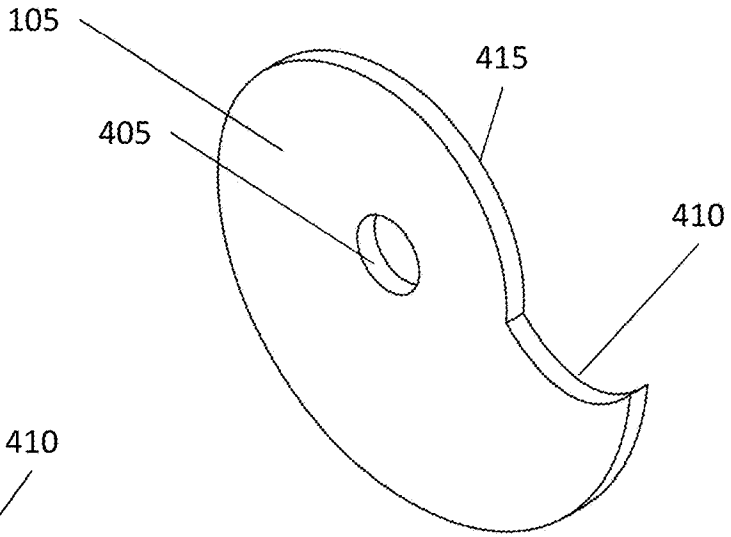
FIGS. 4A-D show views of exemplary baffles for a dynamic boundary pressure zone microphone assembly in accordance with aspects of the disclosure.
Figure 4A:
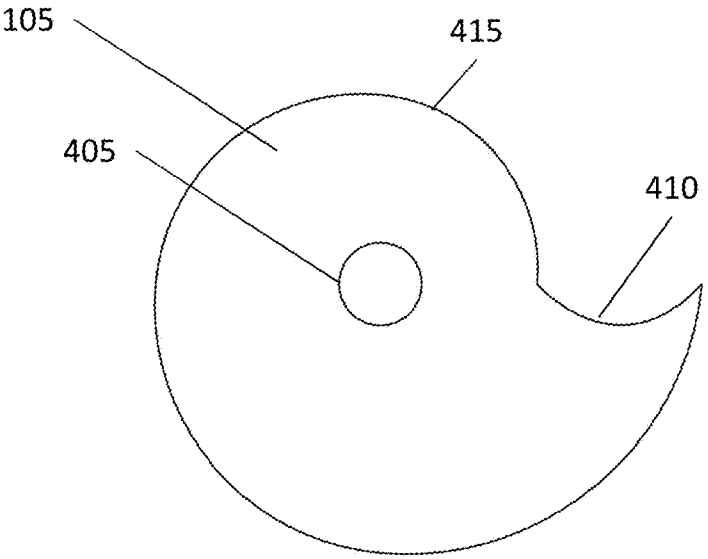
Figure 4C:
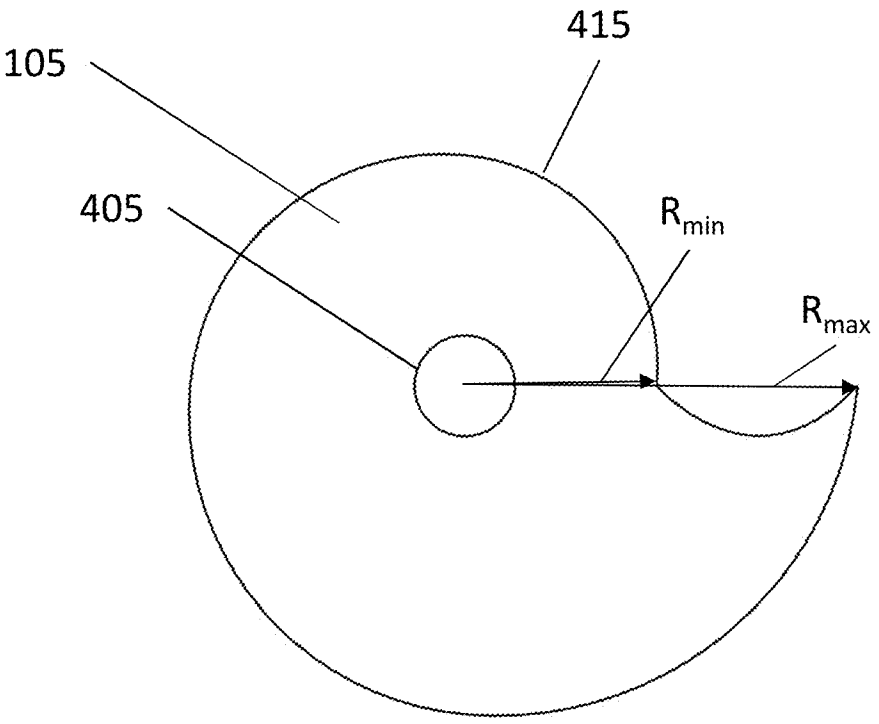

FIGS. 4A-C show views of an exemplary nautilus-shaped baffle 105 for a pressure zone microphone assembly in accordance with aspects of the disclosure. FIG. 4A shows a top view of an exemplary nautilus-shaped baffle 105 (e.g., having a parametric spiral) for a dynamic boundary pressure zone microphone assembly in accordance with aspects of the disclosure. As shown in FIG. 4A, the exemplary nautilus-shaped baffle 105 includes a perimeter (or baffle edge) 415. The perimeter (or baffle edge) 415 has a constantly changing distance from the center of the microphone diaphragm to the edge of the baffle 105. That is, as shown in FIG. 4A, the radius of the baffle constantly varies around the perimeter 415 of the baffle 105. The exemplary nautilus-shaped baffle 105 includes a "center" hole 405 that is sized to accommodate a particular microphone capsule (not shown) and microphone housing (not shown). While described as a "center" hole, it should be understood that the hole 405 is may not be at the center of the baffle, but rather the center hole is arranged around the point from which the varying radius of the nautilus shaped baffle project. The baffle 105 also includes an arced portion 410 between the smallest distance from the center of the microphone diaphragm to the edge of the baffle 105 and the largest distance from the center of the microphone diaphragm to the edge of the baffle 105. In further contemplated embodiments, the arced portion 410 between the smallest distance from the center of the microphone diaphragm to the edge of the baffle 105 and the largest distance from the center of the microphone diaphragm to the edge of the baffle 105 could instead be a straight portion.

FIG. 4B shows a perspective view of an exemplary nautilus-shaped baffle 105 for a dynamic boundary pressure zone microphone assembly in accordance with aspects of the disclosure. As shown in FIG. 4B, the radius of the baffle constantly varies around the perimeter 415 of the baffle 105 with the arced portion 410 between the smallest distance from the center of the microphone diaphragm to the edge of the baffle 105 and the largest distance from the center of the microphone diaphragm to the edge of the baffle 105. As shown in FIG. 4B, the hole 405 projects through the baffle 105 so as to receive a particular microphone capsule (not shown) and microphone housing (not shown). In embodiments, the microphone housing (not shown) or the microphone capsule (not shown) may be frictionally engaged with the baffle. In other contemplated embodiments, the microphone housing (not shown) or the microphone capsule (not shown) may be fastened to the baffle, for example using an adhesive arranged on the inner wall surface of the hole 405.

FIG. 4C shows a top view of an exemplary nautilus-shaped baffle 105 for a dynamic boundary pressure zone microphone assembly in accordance with aspects of the disclosure. As shown in FIG. 4C, in accordance with aspects of the disclosure, a chambered nautilus shell-shaped baffle has a constantly changing distance from the center of the microphone diaphragm to the edge of the plate. That is, as shown in FIG. 4C, the radius of the baffle constantly varies around the circumference of the baffle 105. With such an arrangement, in accordance with aspects of the disclosure, the distance from the center of the microphone capsule (not shown) arranged in the hole 405 to the edge of the baffle 105 is constantly changing from the minimum radius $R_{min}$ to the maximum radius $R_{max}$. In accordance with aspects of the invention, by utilizing such an asymmetrical shape, the microphone-to-edge distance is a constantly changing wavelength, and as such, the microphone does not favor any particular frequency and reduces unwanted enhancement of acoustic resonant frequencies. More specifically, we're minimizing the impact of the baffle on the existing frequency response of the microphone. The mic may not have a totally flat response, but the baffle will ideally not affect it even if it is non-ideal.

Figure 4D:
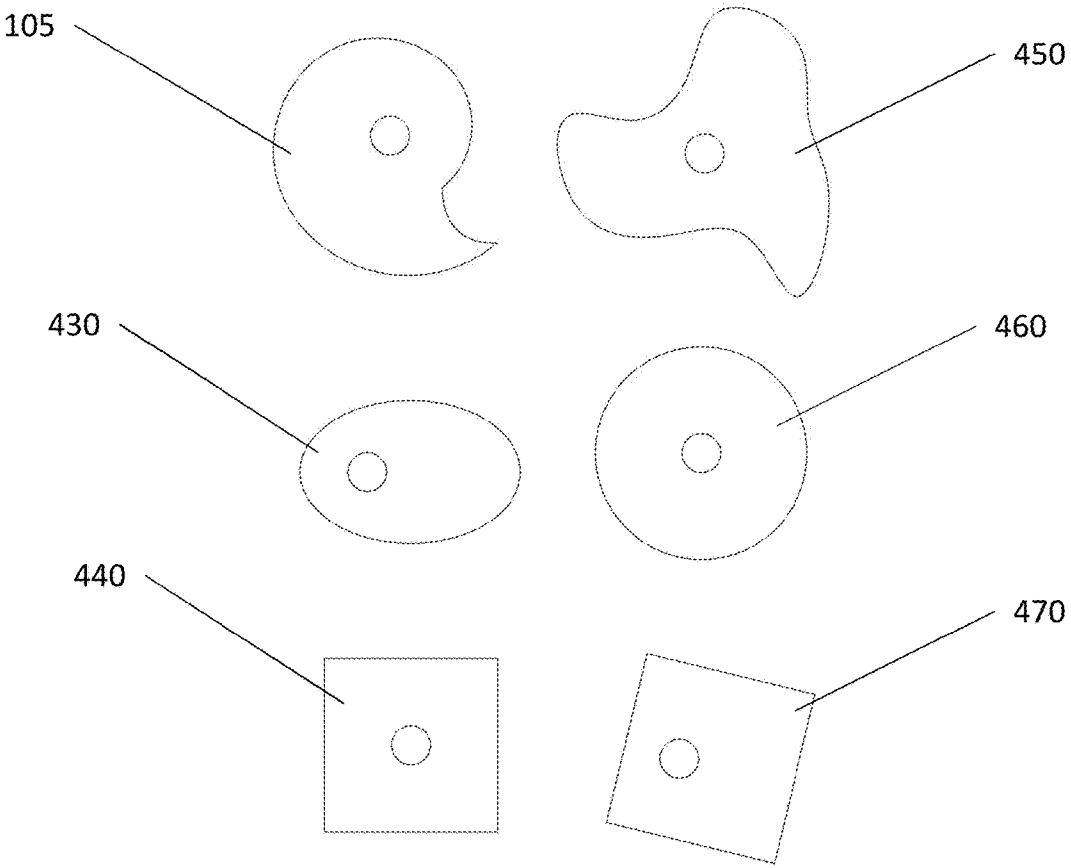

As noted herein, with embodiments of the disclosure, the shape of the baffle plate is non-symmetrical to reduce acoustic resonant frequencies. For example, the baffle may have a nautilus shape. It should be noted, however, that in some environments or instruments a symmetrical baffle may be preferred. As shown in FIG. 4D, in addition to the nautilus baffle 105, other contemplated symmetrical and non-symmetrical baffles include a circular baffle 460, square baffles 440, 470, an elliptical baffle 430, and non-regular "blob" baffle 450 with both centered microphone positions (e.g., square baffle 440) and non-centered microphone positions (e.g., square baffle 470).

Figure 5A:
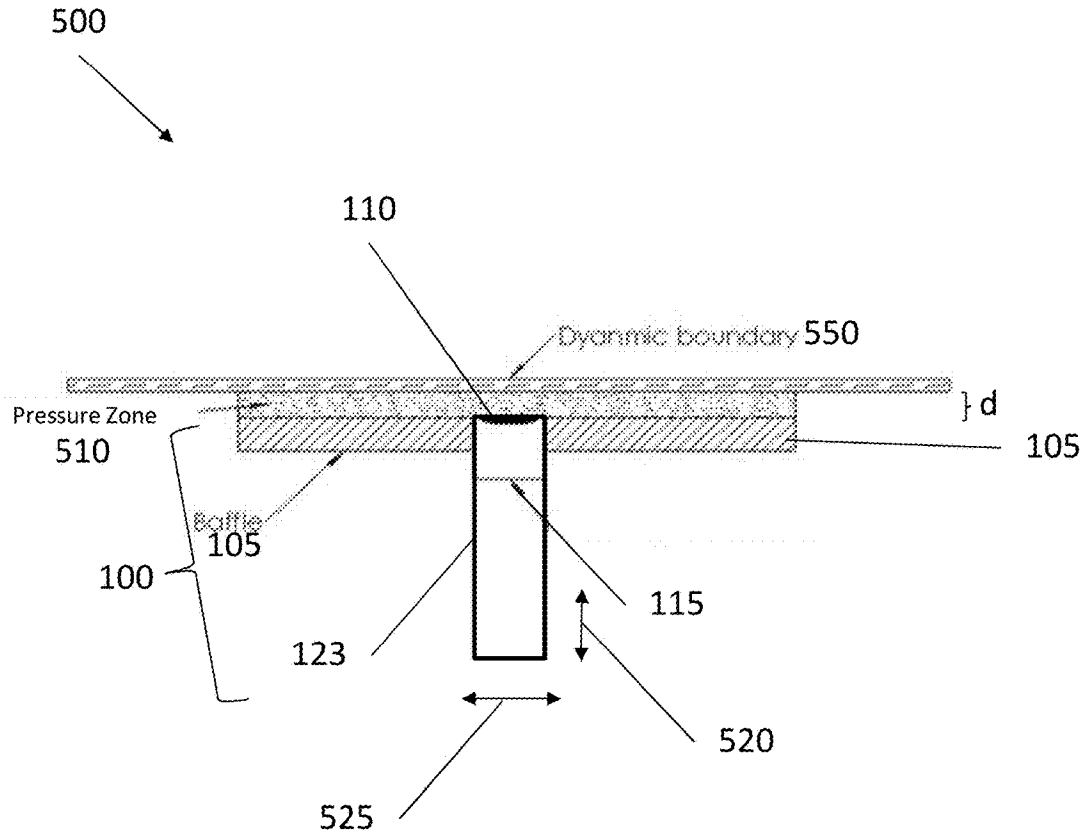
FIGS. 5A and 5B are sectional side views of elements of dynamic boundary pressure zone microphone assembly arranged relative to a dynamic boundary in accordance with aspects of the disclosure.
Figure 5B:
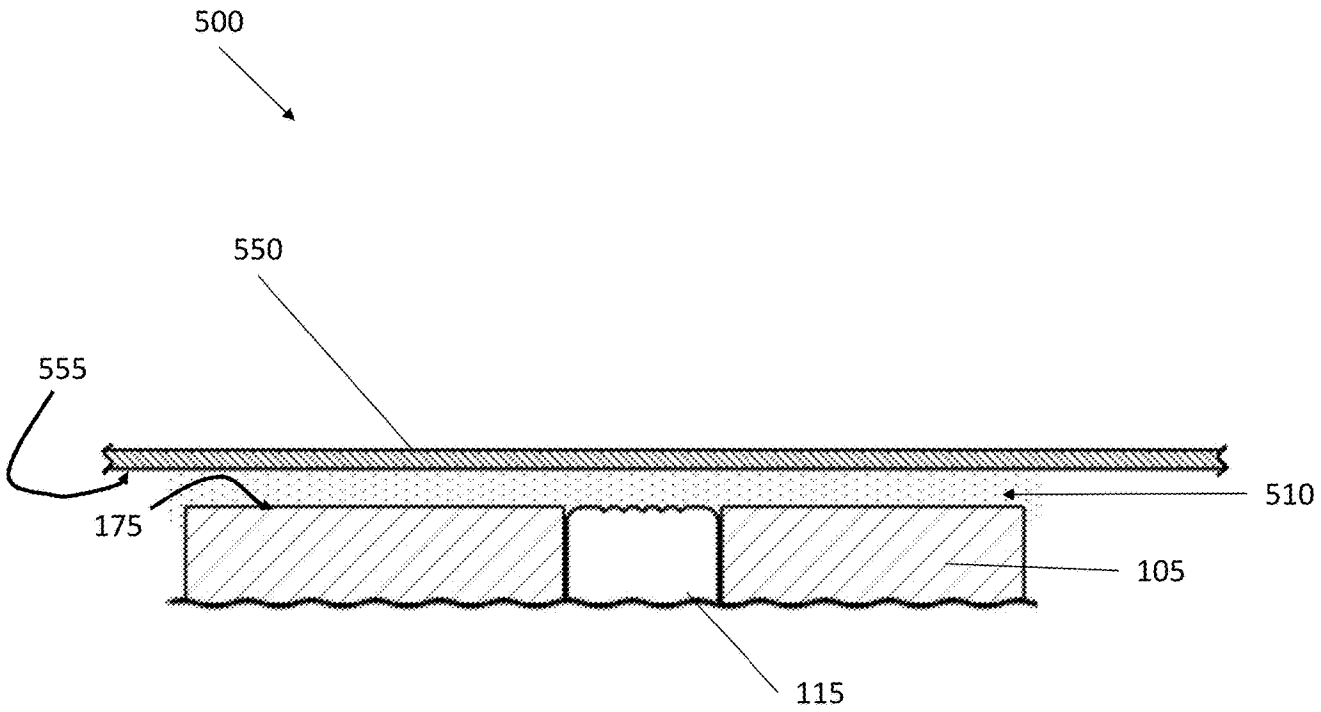

FIGS. 5A and 5B are sectional side views of elements of a dynamic boundary pressure zone microphone assembly 100 arranged relative to a dynamic boundary 550 in accordance with aspects of the disclosure. As should be understood, the microphone 115 and baffle 105 of the microphone assembly 100 are statically mounted very close (for example, within 1") to a vibrating surface of the instrument (which is the dynamic boundary 550). In accordance with aspects of the disclosure, this close proximity creates a sound pressure zone 510 established by one fixed wall (i.e., the statically arranged baffle 105) and another moving and dynamic wall or dynamic boundary 550 (i.e., the soundboard or vibrating diaphragm of the musical instrument). In embodiments, the perimeter of the sound pressure zone 510 may be open (e.g., as shown in FIG. 5A) or partially enclosed (e.g., using a gasket). This arrangement enhances the sound pressure level within the sound pressure zone 510, and changes the pickup pattern of the microphone to strongly favor sound within the zone and suppress sound outside the sound pressure zone from getting into the microphone capsule, greatly improving sonic isolation and helping to reduce feedback tendencies. By implementing aspects of the disclosure, the sensitivity of the transducer (or microphone 115) may be substantially increased.

For example, FIG. 5A is a schematic sectional side view 500 of elements of the dynamic boundary pressure zone microphone assembly 100 arranged relative to a dynamic boundary 550 in accordance with aspects of the disclosure. As shown in FIG. 5A, the dynamic boundary pressure zone microphone assembly 100 is structured so as to be fixedly (or statically) closely mounted relative to a dynamic boundary 550 such that a pressure zone 510 is formed between a surface of the dynamic boundary 550 and a surface of the baffle 105. As also shown in FIG. 5, the microphone capsule 115 is arranged in the microphone housing 123 and arranged so that the sound inlet 110 is approximately flush with the facing surface of the baffle 105. In accordance with aspects of the disclosure, in embodiments the baffle 105 is mounted closely on the plane of the microphone diaphragm, with flush mounting being preferable (and difficult because the actual microphone diaphragm may be slightly below the surface of the face of the microphone capsule). Moreover, as shown in FIG. 5, in certain embodiments, the microphone assembly 100 is mounted so that the baffle 105 is parallel to (or approximately parallel to) the dynamic boundary 550.

In accordance with aspects of the disclosure, mounting the baffle 105 in close proximity to the vibrating diaphragm (or dynamic boundary 550) creates a high sound pressure level zone 510 that is reasonably isolated from farther distances, thus enhancing the signal to noise and ambient sound ratio. As noted above, the baffle may be symmetrical or asymmetrical to enhance wide and flat frequency response. In accordance with aspects of the disclosure, in embodiments, the distance of the microphone assembly 100 from the dynamic boundary 550 and/or the lateral location of the microphone assembly 100 may be adjustable to suit tonal variations.

For example, with reference to FIG. 5A, by mounting the microphone capsule 115 in a rigidly supported baffle 105 and placing the arrangement at a distance d from the dynamic boundary 550 in close proximity (typically at a ⅛" to 1" distance) to the dynamic boundary 550 (or vibrating membrane), the space between the baffle 105 and membrane 550 becomes a high sound pressure zone 510. In embodiments, the proximity or distance d of the baffle 105 to the dynamic boundary 550 may depend on the size of the baffle (which in turn may depend upon the size and/or configuration of the musical instrument). With an exemplary and non-limiting embodiment, proximity or distance d may be defined as an arrangement of the system such that the distance d from the center of the microphone capsule to the vibrating membrane (or proximity) is less than or equal to one half of the average radial distance from the center of the microphone capsule to the edge of the baffle (or with reference to FIGS. 4C and 5A, $d \leq \frac{1}{2}(R_{min}+R_{max})/2)$). With an exemplary and non-limiting embodiment, e.g., for a banjo version of the dynamic boundary pressure zone microphone, $R_{min}$ may be approximately 0.85" and $R_{max}$ may be approximately 1.75".

In accordance with aspects of the disclosure, the baffle 105 is large enough to give an enhanced degree of sonic isolation from outside sounds. The baffle 105, however, should be sized (e.g., not so large) to prevent effecting the compliance of the vibrating diaphragm. Additionally, the baffle 105 is operable to shape (e.g., focus, concentrate, or widen) the pickup pattern of the microphone 115 such that the microphone 115 acts more like it is at a distance from the sound source (e.g., the vibrating membrane 550 (or dynamic boundary)), while at the same time having greatly reduced tendency to feedback acoustically.

As should be understood, the dynamic boundary 550 is a moving surface (e.g., vibrating membrane) of a musical instrument. For example, if the musical instrument is a banjo, then the dynamic boundary 550 may be the head of the banjo. With another contemplated embodiment, if the musical instrument is a mandolin, then the dynamic boundary 550 may be top plate (or back plate) of the mandolin. With other contemplated embodiments, the pressure zone microphone assembly 100 may be used with a guitar, violin, viola, cello, bass, drum, or piano, or any other musical instrument with a vibrating membrane as a primary sound producing element.

As noted above, the baffle 105 is mounted to a structure (e.g., housing (not shown) and microphone housing 123) that allows adjustment of both proximity to the dynamic boundary 550 (or moving diaphragm or head) in directions 520 as well as lateral positioning in directions 525 to a place experimentally determined to have the best tone. As noted above, the baffle 105 (while selectively positional) is statically (or rigidly) mounted relative to a rest-position of the dynamic boundary (or moving diaphragm) 550 so as to maximize isolation and the establishment of the high pressure sonic zone 510 and preserve the best phase response. It should be understood that statically mounted indicates that the microphone does not move with respect to a rest-position of the body of the instrument (e.g., when the instrument is not be played). While a microphone may be statically mounted so that it does not move with respect to a rest-position of the body of the instrument, it should be understood that, in some contemplated embodiments, the microphone may include non-rigid couplings, e.g., for shock absorption.

FIG. 5B shows a closer sectional side view 500 of elements of a pressure zone microphone assembly arranged relative to a dynamic boundary 550 in accordance with aspects of the disclosure. As shown in FIG. 5B, a statically supported baffle 105 and microphone capsule 115 are place in close proximity (typically ⅛" to 1" distance) to a vibrating membrane 550 (or dynamic boundary). In accordance with aspects of the disclosure, the space between the upper surface 175 of the baffle 105 and lower surface 555 of the membrane 550 becomes a high sound pressure zone 510.

Figure 6:
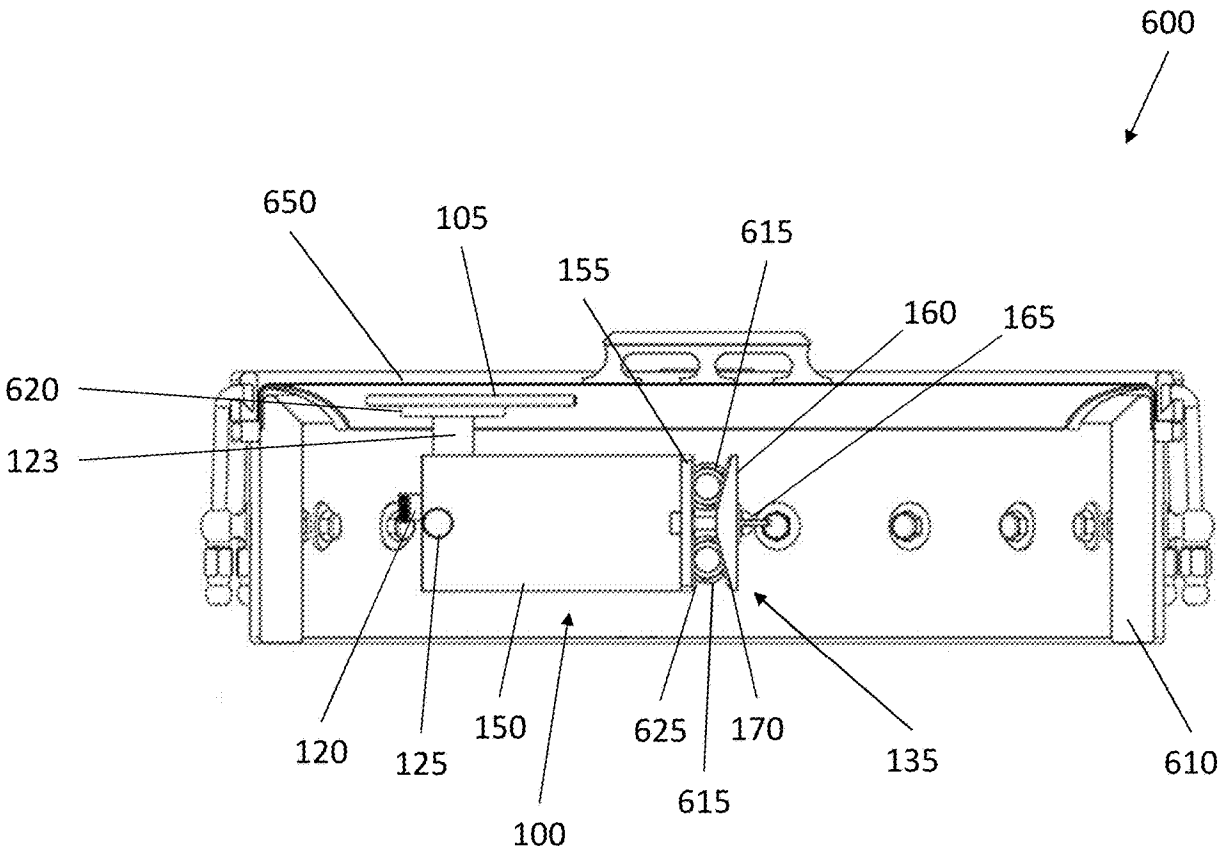
FIG. 6 illustrates a sectional side view of a dynamic boundary pressure zone microphone assembly arranged in a musical instrument (e.g., banjo) in accordance with aspects of the disclosure.
Figure 7:
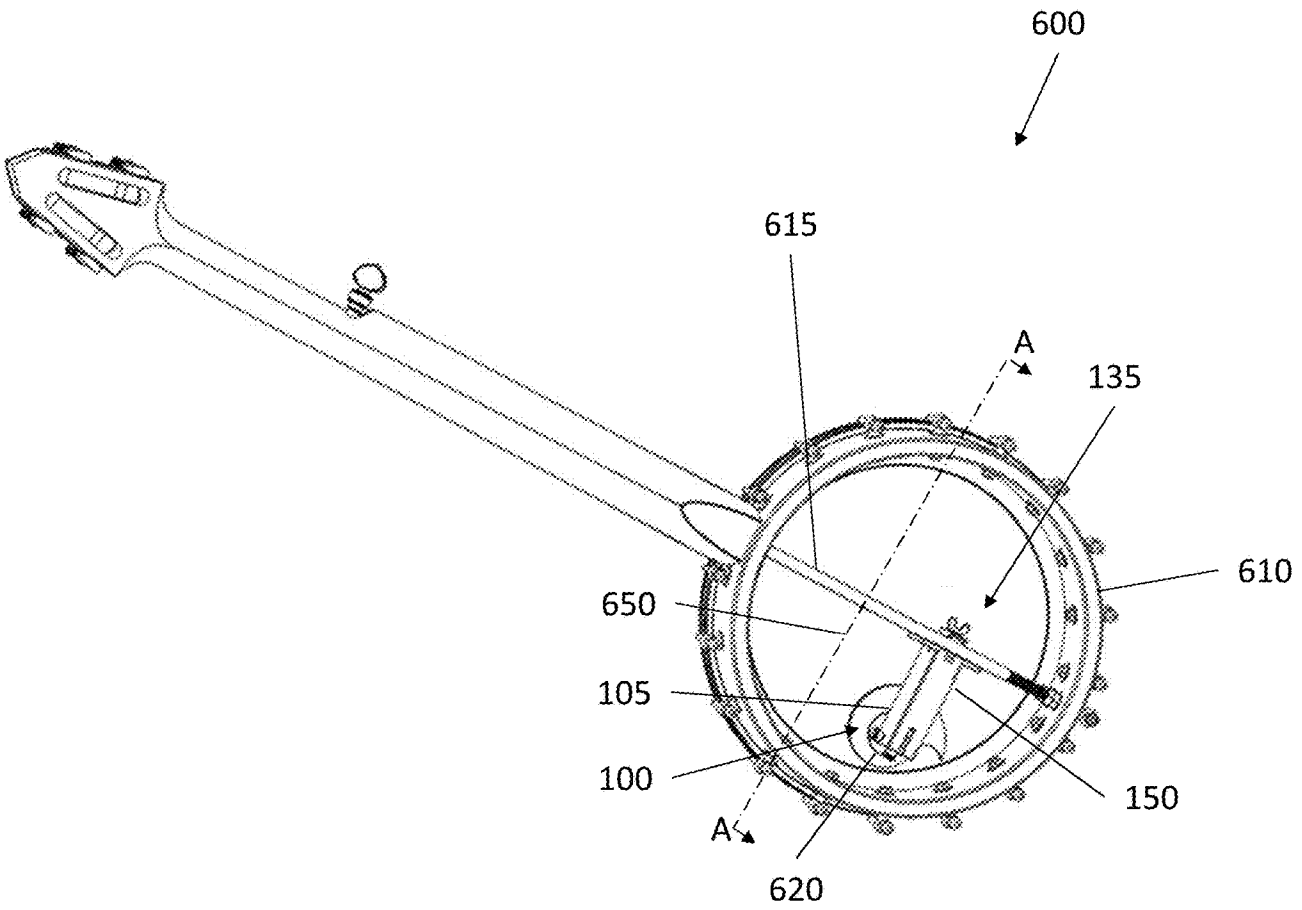
FIG. 7 illustrates a bottom perspective view of a dynamic boundary pressure zone microphone assembly arranged in a musical instrument (e.g., banjo) in accordance with aspects of the disclosure.

FIG. 6 illustrates a sectional side view (along section line A-A as shown in FIG. 7) of a pressure zone microphone assembly 100 arranged in a musical instrument (e.g., banjo 600) in accordance with aspects of the disclosure. As shown in FIG. 6, the pressure zone microphone assembly 100 includes the housing 150, microphone housing 123, microphone capsule (not shown), and baffle 105. The pressure zone microphone assembly 100 also includes a mounting assembly 135 including the back plate 155 (with cushioning, vibration-dampening material 625), the clamping plate 160 (with cushioning, vibration-dampening material 170) and the fastener 165. The banjo 600 includes a wall 610 over which a membrane (or head) 650 is tensioned. The membrane 650 of the banjo acts as the dynamic boundary. The banjo 600 also includes coordinator rods 615. As shown in FIG. 6, with this exemplary embodiment, the microphone assembly 100 is statically secured to the banjo 600 by attaching the mounting assembly 135 to the coordinator rods 615. For example, as shown in FIG. 6, the fastener 165 is tightened so that the back plate 155 and the clamping plate 160 clamp the center rods 615 there between so as to fix the microphone assembly 100 statically relative to the membrane 650, which acts as the dynamic boundary. As shown in FIG. 6, when positioned in the banjo 600, the microphone assembly 100 is arranged such that the baffle 105 and microphone is properly spaced from the membrane 650 of the banjo so as to create a pressure zone there between. In embodiments, the baffle 105 and microphone may be spaced about ⅛" to 3/16" from the banjo head or membrane 650. In other contemplated embodiments, the baffle 105 and microphone may be spaced about ⅛" to ½" from the banjo head or membrane 650. In accordance with aspects of the disclosure, the spacing of the baffle from the dynamic boundary may be adjusted to mediate the sound pressure level (or SPL). For example, when the baffle is very close and the SPL is high, the system has less dynamic range, but better feedback resistance. In accordance with aspects of the disclosure, spacing may be adjusted for desired tone and performance needs.

FIG. 6 also shows knob 120, which is operable to allow a repositioning or adjustment of the static location of the microphone and baffle 105. As placement/arrangement of the microphone and baffle 105 can impact the sonic qualities of the received signal, the baffled microphone to vibrating diaphragm placement is adjustable. For example, certain spots on the instrument soundboard or vibrating diaphragm may be found to be better than others. Upon repositioning, the knob 120 is tightened so as to fix the location of the microphone housing 123 (and thus fix the location of the microphone capsule 115 and baffle 105) relative to the instrument soundboard or vibrating diaphragm.

As additionally shown with the exemplary embodiment of FIG. 6, in embodiments, the microphone assembly 100 may include a baffle support 620 arranged on the microphone housing 123 and below the baffle 105. In accordance with aspects of the disclosure, the baffle support 620 provides an additional support for fastening the baffle to the microphone housing 123. In embodiments, the baffle support 620 may be a flat support that is smaller (e.g., has a smaller radius) than minimum radius of the nautilus-shaped baffle 105. In embodiments, the baffle support 620 may comprise metal, wood, polymer, composite, and any combination thereof. For example, with this exemplary embodiment, the baffle support 620 may be frictionally-engaged with or welded, glued (or otherwise secured) to the microphone housing 123, and the downward facing surface of the baffle 105 may be frictionally-engaged with the microphone housing 123 and the upward facing surface of the baffle support 620 (or in embodiments, secured to the upward facing surface of the baffle support 620 using an adhesive).

FIG. 7 illustrates a bottom perspective view of a pressure zone microphone assembly 100 arranged in a musical instrument (e.g., banjo 600) in accordance with aspects of the disclosure. As shown in FIG. 7, the pressure zone microphone assembly 100 includes the housing 150, microphone housing (not shown), microphone capsule (not shown), and baffle 105. The pressure zone microphone assembly 100 also includes a mounting assembly 135. The banjo 600 includes a wall or rim 610 over which the membrane (or drum) 650 is tensioned. As shown in FIG. 7, the banjo 600 also includes center rods 615, and the microphone assembly 100 is statically secured to the banjo 600 by attaching the mounting assembly 135 to the center rods 615. When secured to the banjo 600, the baffle 105 of the microphone assembly 100 is statically arranged at a distance from the membrane 650, which acts as the dynamic boundary. As additionally shown with the exemplary embodiment of FIG. 7, in embodiments, the microphone assembly 100 may include a baffle support 620 arranged on the microphone housing (not shown) and below the baffle 105.

Figure 8:
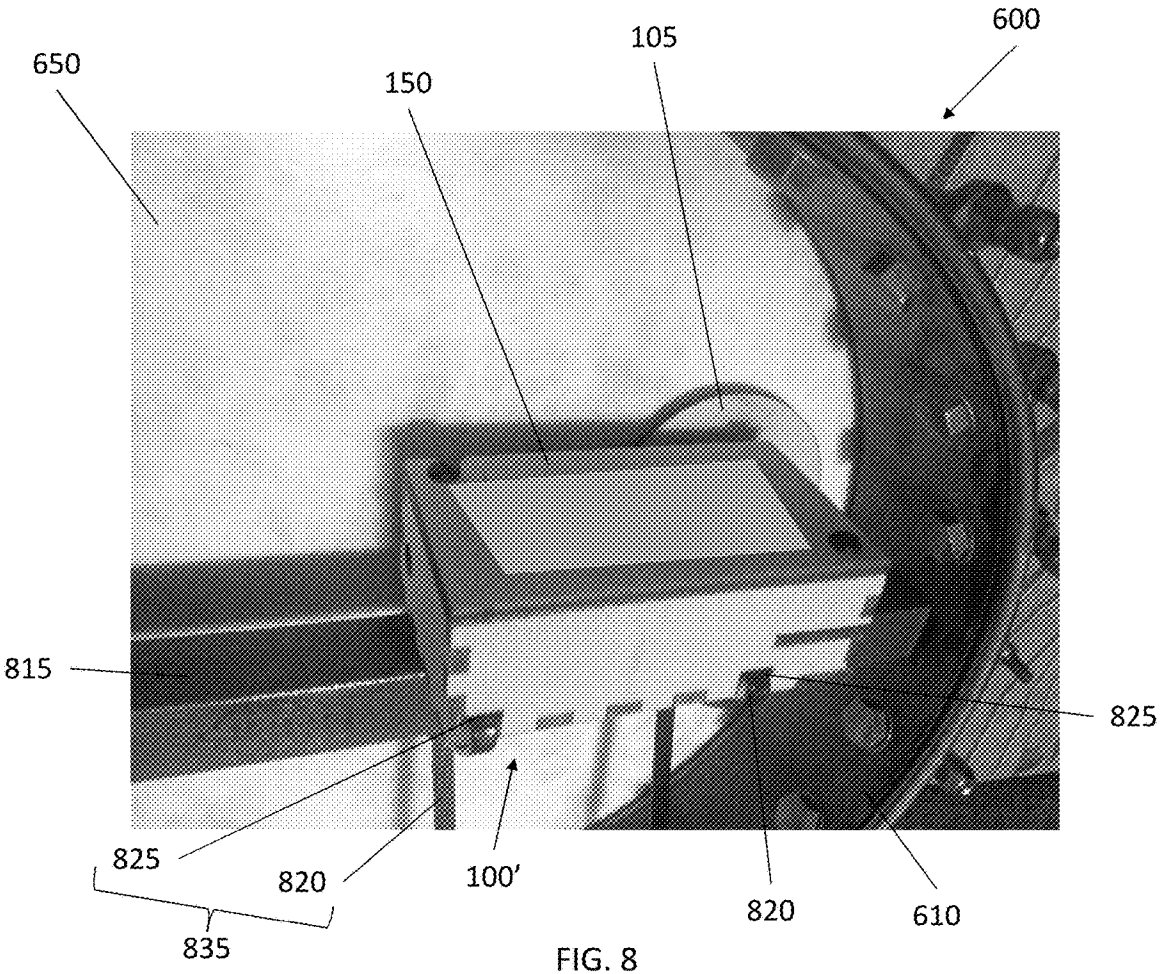
FIG. 8 is a photograph of a bottom perspective view of an exemplary dynamic boundary pressure zone microphone assembly arranged in a musical instrument (e.g., banjo) in accordance with aspects of the disclosure.

FIG. 8 is a photograph of a bottom perspective view of an exemplary pressure zone microphone assembly 100' arranged in a musical instrument (e.g., banjo 600) in accordance with aspects of the disclosure. As shown in FIG. 8, the pressure zone microphone assembly 100' includes the housing 150, microphone housing (not shown), microphone capsule (not shown), and baffle 105. The pressure zone microphone assembly 100' also includes a mounting assembly 835, which with this exemplary embodiment includes a pair of zip ties 820 and respective zip tie passages 825 in the housing 150. The banjo 600 includes a wall or rim 610 over which the membrane (or drum) 650 is tensioned. As shown in FIG. 8, the banjo 600 also includes a center beam (or dowel stick) 815, and the microphone assembly 100 is statically secured to the banjo 600 by passing the zip ties 820 through the respective zip tie passages 825 and around the dowel stick 815, and then locking the zip ties 820 closed. When secured to the banjo 600, the baffle 105 of the microphone assembly 100 is statically arranged at a distance from the membrane 650, which acts as the dynamic boundary.

Figure 9A:
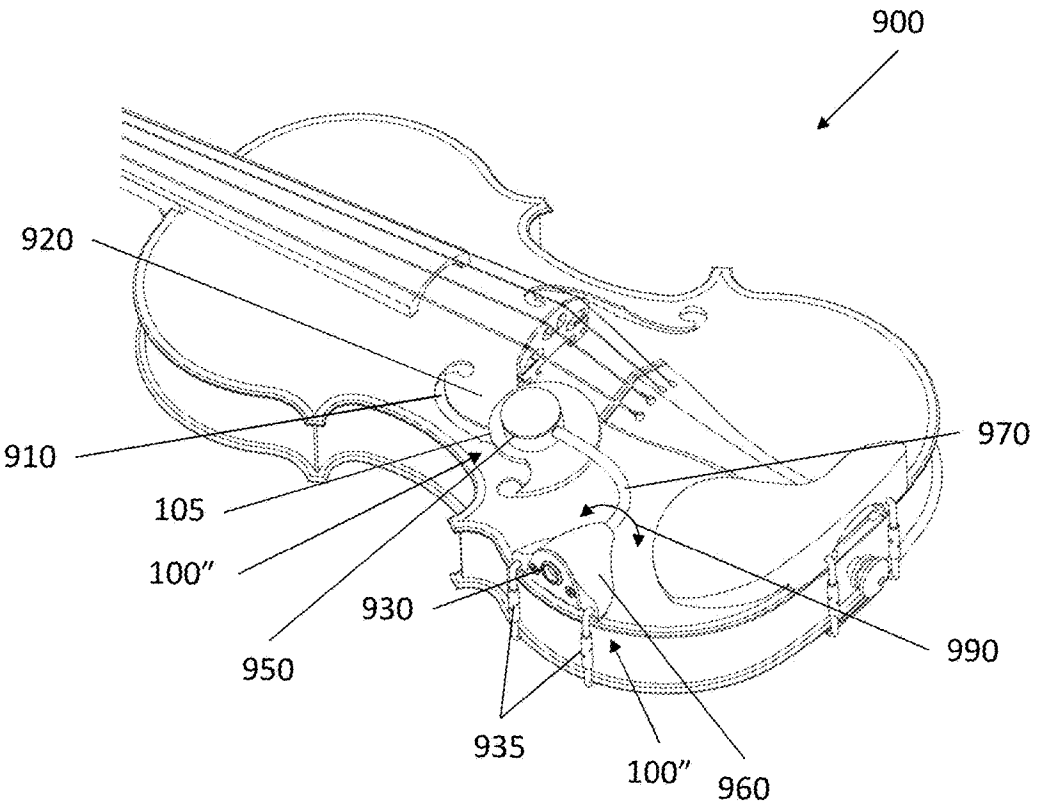
FIGS. 9A-9D illustrate various views of an exemplary dynamic boundary pressure zone microphone assembly arranged on a musical instrument (e.g., violin) in accordance with aspects of the disclosure.

FIGS. 9A-9D illustrate various views of an exemplary dynamic boundary pressure zone microphone assembly arranged on a musical instrument (e.g., violin) in accordance with aspects of the disclosure. FIG. 9A illustrates a perspective view of an exemplary dynamic boundary pressure zone microphone assembly 100" arranged on a musical instrument (e.g., violin 900) in accordance with aspects of the disclosure. In embodiments, as explained herein, the microphone may be mounted inside or outside an instrument. An exemplary inside mounting system was described above on a banjo. On instruments like mandolins, violins, and guitars, however, the microphone may be mounted outside an instrument, and the position of the baffle may be fixedly adjustable for optimal coupling proximate to one or more of the instrument's sound holes.

As shown in FIG. 9A, with this exemplary embodiment, the microphone assembly 100" is arranged to attach an external surface of the violin 900 such that the baffle 105 is arranged above (and/or approximate to) one of the f-holes 910 and securely spaced from the outer surface of the violin 900. As should be understood, with this exemplary arrangement, the outer surface 920 of the violin body acts as the dynamic boundary. As shown in FIG. 9A, the pressure zone microphone assembly 100" includes microphone housing 950, microphone capsule (not shown) arranged in the microphone housing 950, and a baffle 105 secured to the microphone housing 950. With this exemplary embodiment, the pressure zone microphone assembly 100" additionally includes a housing 960 which is fixedly secured to the violin 900 with a mounting assembly 935. In embodiments, the mounting assembly 935 may include brackets configured to attach to the body of the violin 900. In embodiments, the housing 960 may accommodate at least some of the electronics, and includes a connection jack 930 for connecting a cable for transmitting the signals received by the microphone capsule (not shown).

Additionally, the microphone assembly 100" includes a support beam 970 (e.g., hollow metal tube) projecting from the housing 960 to the microphone housing 950. In accordance with aspects of the disclosure, the support beam 970 is operable to statically maintain the position of the microphone housing 950, such that the baffle 105 and microphone capsule (not shown) are suitably positioned to provide the pressure zone between the facing surface of the baffle (i.e., the surface of the baffle facing the dynamic boundary) and the surface of the violin 900. With an exemplary embodiment, a spacing between the facing surface of the baffle and the surface of the violin 900 (or fiddle) may be in the range of ⅛" to ½". While the support beam 970 is operable to statically maintain the position of the microphone housing 950 relative to the surface of the violin 900, in embodiments, the position of the support beam 970 may be adjusted (e.g., rotated in direction 990) and fixed in a new location and/or the support beam 970 may be bent into a new location, e.g., for finer adjustment. As should be understood, in embodiments, the support beam 970 may also serve to accommodate wires passing from the microphone capsule (not shown) to the output jack 930.

Figure 9B:
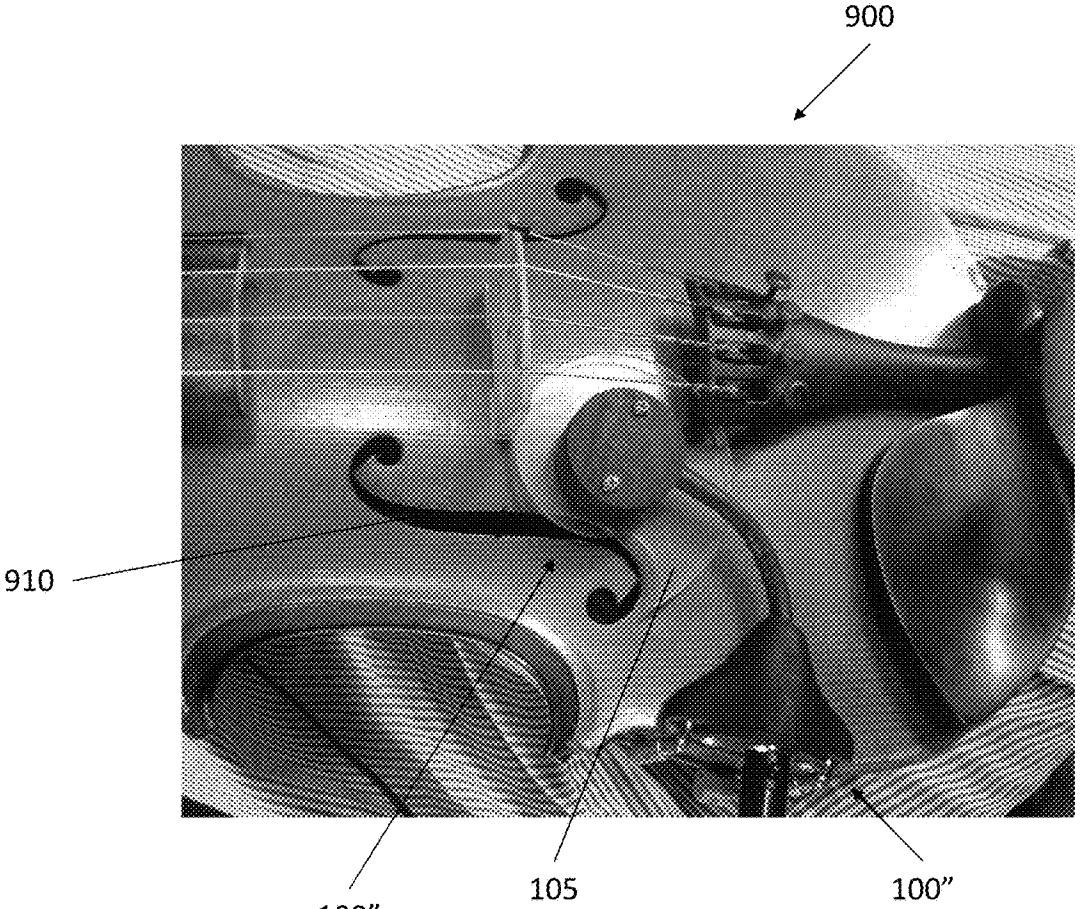
Figure 9C:
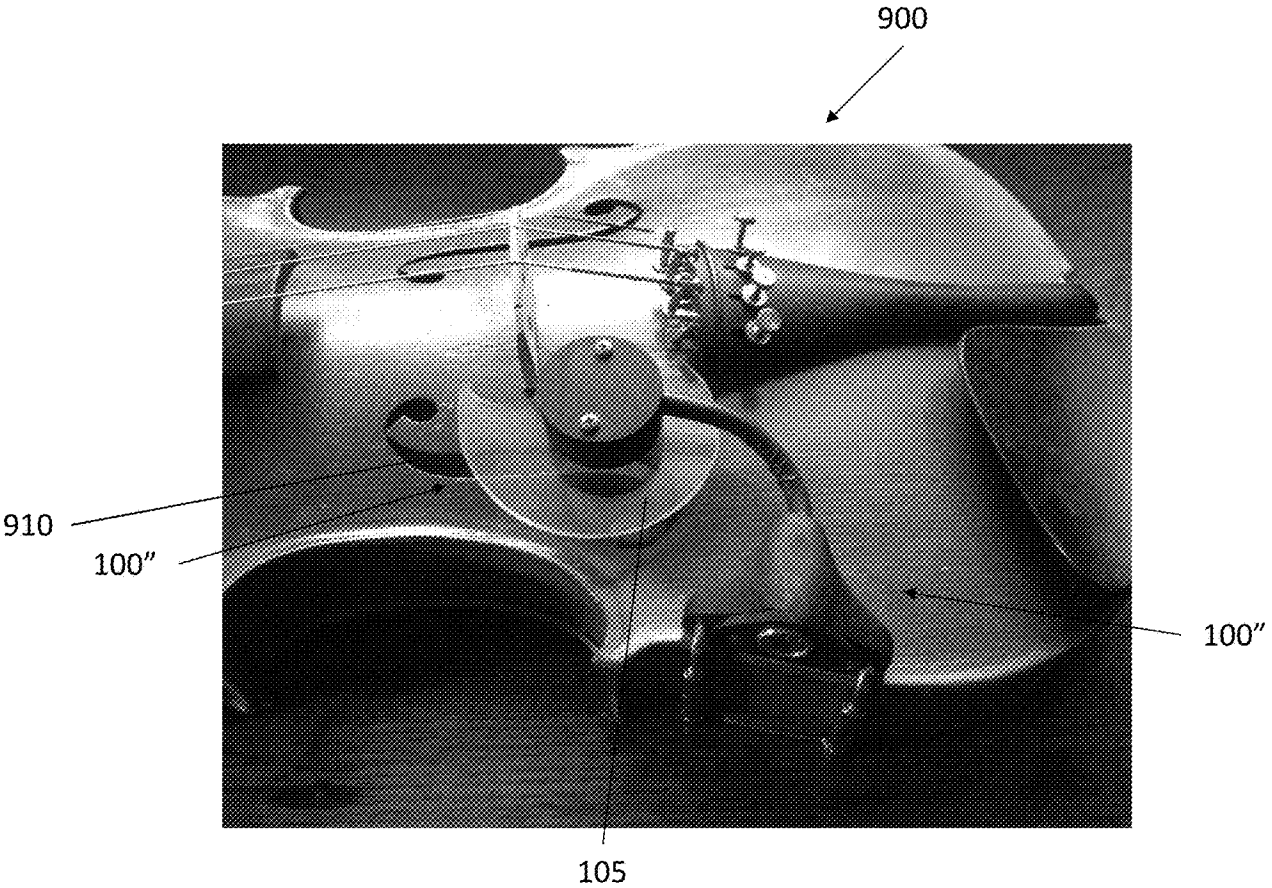
Figure 9D:
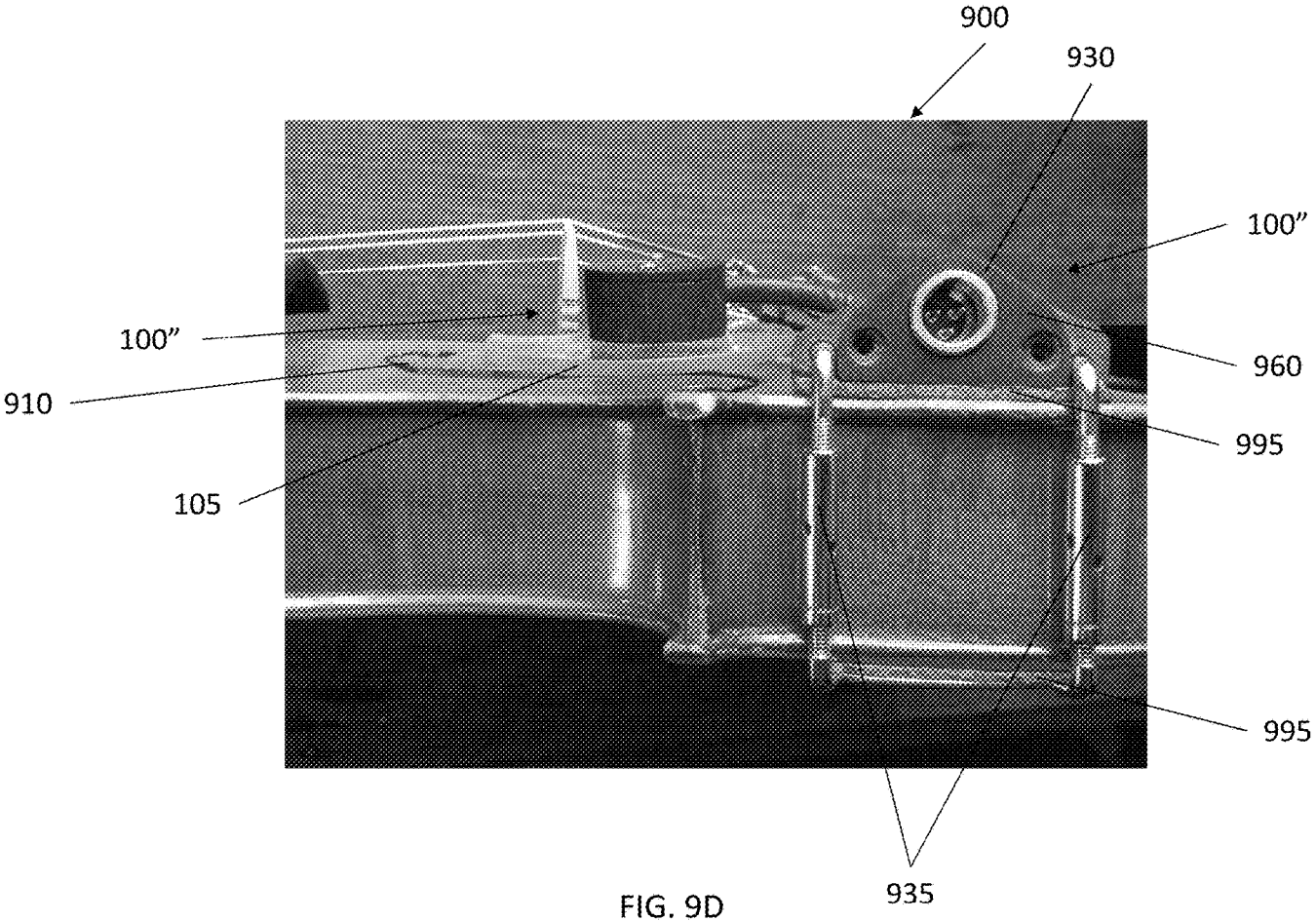

FIGS. 9B-9D illustrate various photographs of an exemplary dynamic boundary pressure zone microphone assembly arranged on a musical instrument (e.g., violin) in accordance with aspects of the disclosure. As shown in FIGS. 9B-9D, the microphone assembly 100" is arranged to attach an external surface of the violin 900 such that the baffle 105 is arranged above (and/or approximate to) one of the f-holes 910 and securely spaced from the outer surface of the violin 900. Additionally, as shown in in FIGS. 9B-9D, the baffle 105 may be clear or translucent, e.g., so as preserve the aesthetic appearance of the instrument. Additionally, as shown in in FIGS. 9B and 9C, the baffle 105 can be repositioned, for example to cover more of the f-hole 910. As shown in FIG. 9D, the housing 960 is fixedly secured to the violin 900 with a mounting assembly 935, include brackets configured to attach to the body of the violin 900. As shown in FIG. 9D, the housing 960 includes a connection jack 930 for connecting a cable for transmitting the signals received by the microphone capsule (not shown). As also shown in FIG. 9D, a padding material 995 (e.g., foam, rubber, or plastic layer) may be arranged between the housing 960 and the violin 900 and/or between the mounting assembly 935 and the body of the violin 900.

Figures 10A, 10B, 10C, 10D:
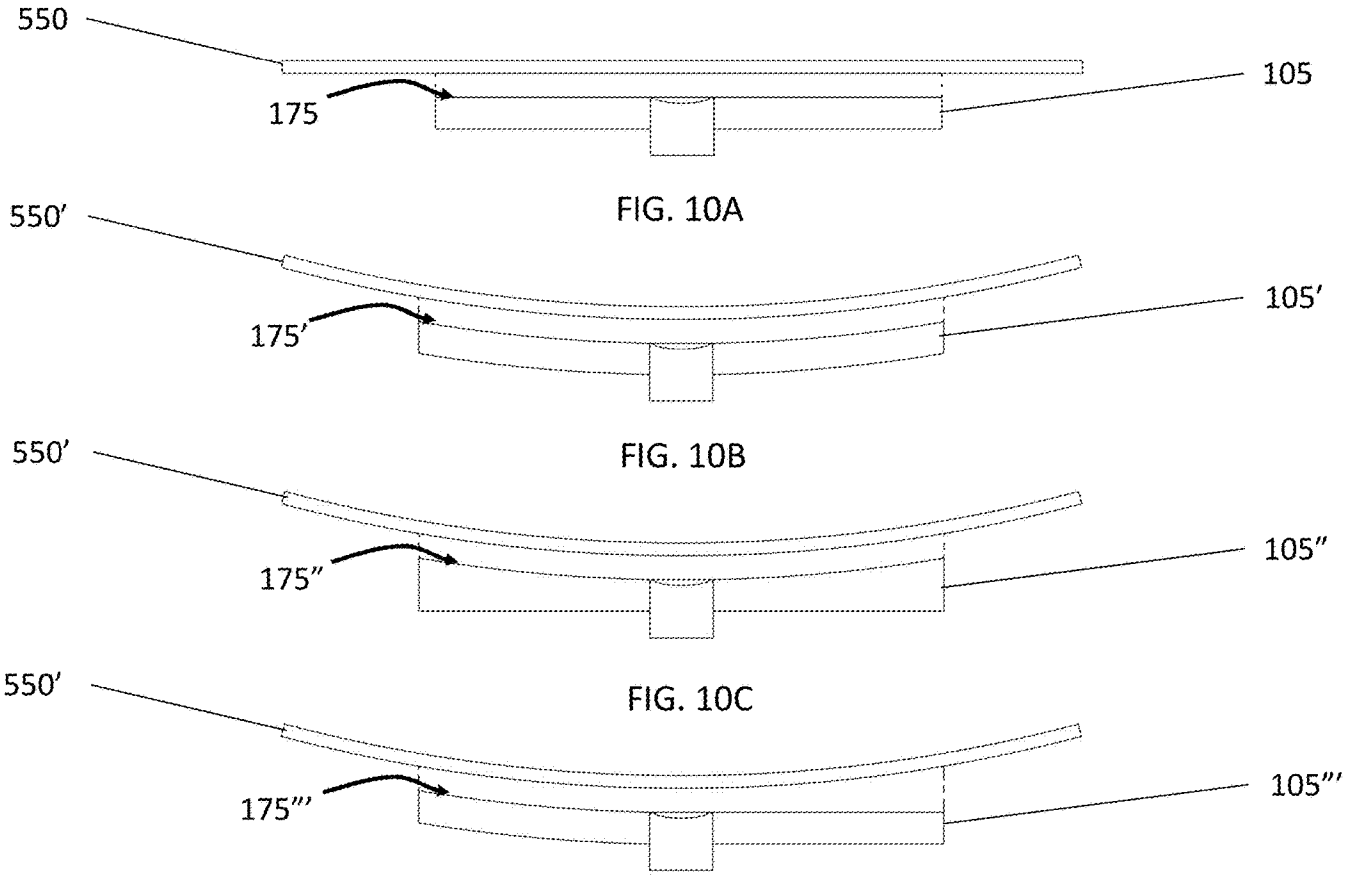
FIGS. 10A-10D illustrate sectional views of various embodiments of the baffle in accordance with aspects of the disclosure.

FIGS. 10A-10D illustrate various embodiments for the baffle in accordance with aspects of the disclosure. In embodiments, the baffle surface may be flat or contoured to best suit the physical and acoustical needs of different instruments or applications. In some embodiments, for example, the baffle (and baffle surface) may be essentially flat to work with instruments like banjo, many guitars, or piano, which may have flat sound boards. Thus, as shown in FIG. 10A, in embodiments, the baffle 105 is essentially flat (and the baffle surface 175 is also essentially flat) to interact with an essentially flat sound board 550, which acts as the dynamic boundary.

In other contemplated embodiments in which the instrument has a curved or contoured soundboard, however, the baffle may be 3-D contoured to better match the curving or arch of the top of a violin family instrument or mandolin, for example. Thus, for example, as shown in FIG. 10B, the baffle 105' itself is curved (so that the baffle surface 175' is also curved) to interact with a curved sound board 550', which acts as the dynamic boundary.

In further contemplated embodiments, the baffle surface (i.e., the surface that is doing the baffling) may be contoured to best suit the physical and acoustical needs of different instruments or applications. Thus, for example, as shown in FIG. 10C, the baffle 105' includes a curved baffle surface 175" to interact with a curved sound board 550', which acts as the dynamic boundary. In contrast to the embodiment of FIG. 10B in which the whole baffle 105' is curved, with the exemplary embodiment of 10C, the baffle surface 175" is curved, whereas the opposite surface is planar. In other words, as shown in FIG. 10C, in embodiments, the curvature of the baffle surface need not mirror the shape of the back of the baffle, and vice versa.

In further contemplated embodiments, portions of the baffle (or portions of the baffle surface) may be 3-D contoured to better match portions of the curving or arch of the top of a violin family instrument or mandolin, for example. Thus, for example, as shown in FIG. 10D, at least some portions the baffle 105'" is curved (so that at least portions of the baffle surface 175'" are also curved) to interact with a curved sound board 550', which acts as the dynamic boundary. In further contemplated embodiments, the baffle of the microphone assembly may be arranged in the pickguard of a mandolin, for example, where the baffle may not be a simple plate, but a surface built into a larger, more geometrically complex component.

It should be understood that references to flat or curved baffle geometry should not restrict application of flat baffles to instruments with flat soundboards or curved baffles to instruments with curved soundboards. That is, the disclosure contemplates using a flat baffle on an instrument with a curved soundboard, and likewise contemplates using a curved baffle on an instrument with a flat soundboard.

Figure 11:
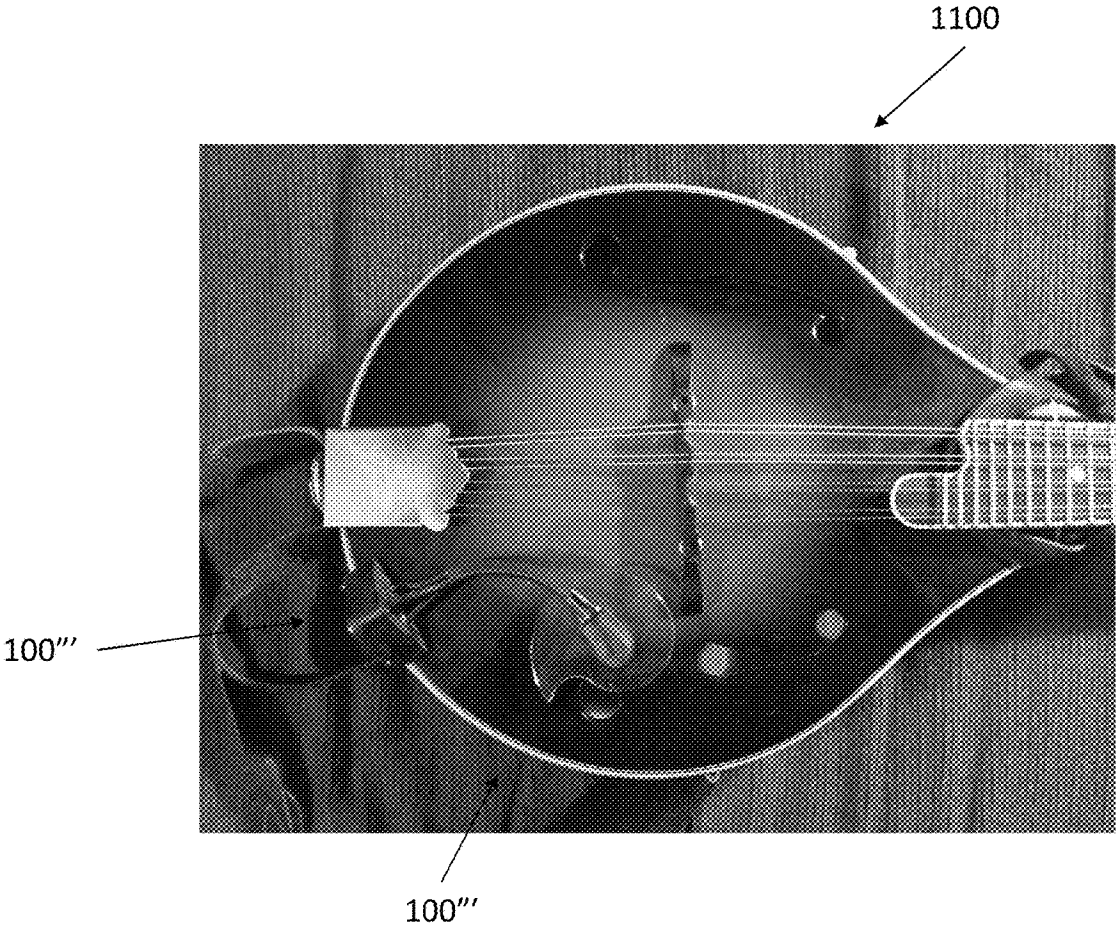
FIG. 11 is a photograph of an exemplary pressure zone microphone assembly arranged on a musical instrument (e.g., mandolin) in accordance with aspects of the disclosure.

FIG. 11 illustrates a perspective view of an exemplary dynamic boundary pressure zone microphone assembly 100'" arranged on a musical instrument (e.g., a mandolin 1100) in accordance with aspects of the disclosure. As shown in FIG. 10, the pressure zone microphone assembly 100'" includes microphone housing, a microphone capsule (not shown) arranged in the microphone housing, and a baffle secured to the microphone housing. With this exemplary embodiment, the pressure zone microphone assembly 100" additionally includes a housing which is fixedly secured to the mandolin 1000 with a mounting assembly.

In other embodiments, a microphone assembly 100 may be used in a piano. For example, one or more microphone assemblies 100 may be mounted to the back side of an upright piano or the underside of a grand piano. In further contemplated embodiments, one or more microphone assemblies 100 may be utilized for drums, with mounted either inside or outside the drum.

While the exemplary embodiments have been described in which the baffle is mounted in (or on) the instrument so as to be parallel to the dynamic boundary, the disclosure contemplates that in some embodiments (for some instruments like drums), it may be desirable to position the microphone baffle at an angle to the dynamic boundary (e.g., moving diaphragm/drum head in this example) rather than parallel to the dynamic boundary. According to an aspect of the disclosure, this non-parallel arrangement may enhance tone somewhat at the expense of a lower sonic feedback threshold.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The Abstract of the Disclosure is provided to comply with 37 C.F.R. § 1.72(b) and is submitted with the understanding that it will not be used to interpret or limit the scope or meaning of the claims. In addition, in the foregoing Detailed Description, various features may be grouped together or described in a single embodiment for the purpose of streamlining the disclosure. This disclosure is not to be interpreted as reflecting an intention that the claimed embodiments require more features than are expressly recited in each claim. Rather, as the following claims reflect, inventive subject matter may be directed to less than all of the features of any of the disclosed embodiments. Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiments which fall within the true spirit and scope of the present disclosure. Thus, to the maximum extent allowed by law, the scope of the present disclosure is to be determined by the broadest permissible interpretation of the following claims and their equivalents, and shall not be restricted or limited by the foregoing detailed description.

Accordingly, the novel configuration is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

While the disclosure refers to specific embodiments, those skilled in the art will understand that various changes may be made and equivalents may be substituted for elements thereof without departing from the true spirit and scope of the embodiments of the disclosure. While exemplary embodiments are described above, it is not intended that these embodiments describe all possible forms of the invention. Rather, the words used in the specification are words of description rather than limitation, and it is understood that various changes may be made without departing from the spirit and scope of the disclosure. In addition, modifications may be made without departing from the essential teachings of the disclosure. Furthermore, the features of various implementing embodiments may be combined to form further embodiments of the disclosure.

What is claimed is:

1. A microphone assembly for a musical instrument, the microphone assembly comprising:

a microphone housing having a longitudinal axis;

a microphone capsule arranged at a first end of the microphone housing; and a baffle statically mounted to the first end of the microphone housing, such that the microphone capsule is arranged within the baffle, wherein the baffle, when statically arranged in proximity to a dynamically moveable surface of the musical instrument, creates a high sound pressure zone between a surface of the baffle and the dynamically moveable surface of the musical instrument, and wherein a diaphragm of the microphone capsule is approximately co-planar with at least a portion of the surface of the baffle surrounding the microphone capsule.

2. The microphone assembly of claim 1, wherein the microphone housing comprises a tube structure.

3. The microphone assembly of claim 1, wherein the surface of the baffle has an asymmetrical shape.

4. The microphone assembly of claim 1, wherein the surface of the baffle has a nautilus shape.

5. The microphone assembly of claim 1, wherein the baffle has a constantly changing distance from the center of the microphone capsule arranged in the baffle to an outer edge of the baffle.

6. The microphone assembly of claim 1, wherein at least a portion of the surface of the baffle is approximately perpendicular to the longitudinal axis.

7. The microphone assembly of claim 1, wherein the baffle is planar.

8. The microphone assembly of claim 1, wherein the baffle surface is planar.

9. The microphone assembly of claim 1, wherein the baffle is contoured or curved.

10. The microphone assembly of claim 1, wherein the baffle surface is contoured or curved.

11. The microphone assembly of claim 1, wherein the surface of the baffle has a symmetrical shape.

12. The microphone assembly of claim 1, further comprising a housing, wherein the microphone housing is adjustably securable to the housing so that a distance between the surface of the baffle and the dynamically moveable surface of the musical instrument is adjustable, and the distance between the surface of the baffle and a rest-position of the dynamically moveable surface of the musical instrument is fixable.

13. The microphone assembly of claim 12, wherein the one end of the microphone housing projects directly from the housing.

14. The microphone assembly of claim 12, wherein the microphone housing is connected to the housing via a support arm.

15. The microphone assembly of claim 12, wherein the housing comprises a fastening assembly structured and arranged for securely and statically mounting the housing in or on the musical instrument, such that the baffle is statically arranged with respect to a rest-position of the dynamically moveable surface of the musical instrument.

16. The microphone assembly of claim 1, further comprising a gasket arranged along an edge of the baffle to provide greater sonic isolation in the high sound pressure zone.

17. The microphone assembly of claim 1, further comprising a surface treatment on the baffle, wherein the surface treatment comprises at least one of felt, cork, rubber, or foam.

18. The microphone assembly of claim 1, wherein the baffle is frictionally-engaged with the microphone housing such that the baffle is rotationally adjustable on the microphone housing.

19. The microphone assembly of claim 1, wherein the baffle includes a hole therein, and wherein the microphone capsule is arranged in the hole.

20. The microphone assembly of claim 1, wherein the microphone capsule is operable to pick up sound vibrations carried through air.

21. The microphone assembly of claim 1, wherein the microphone capsule is a non-contact microphone capsule.

22. A microphone assembly for a musical instrument, the microphone assembly comprising:

a microphone housing having a longitudinal axis;

a microphone capsule arranged at a first end of the microphone housing;

a baffle statically mounted on the first end of the microphone housing, such that the microphone capsule is arranged within the baffle; and a housing, wherein the microphone housing is adjustably securable to the housing, wherein the baffle, when statically arranged in proximity to a dynamically moveable surface of the musical instrument, creates a high sound pressure zone between a surface of the baffle and the dynamically moveable surface of the musical instrument, wherein the surface of the baffle has an asymmetrical shape, wherein a diaphragm of the microphone capsule is approximately co-planar with at least a portion of the surface of the baffle surrounding the microphone capsule, wherein the portion of the surface of the baffle is approximately perpendicular to the longitudinal axis, and wherein a distance between the surface of the baffle and the dynamically moveable surface of the musical instrument is adjustable, and the distance between the surface of the baffle and a rest-position of the dynamically moveable surface of the musical instrument is fixable.

23. The microphone assembly of claim 22, wherein the asymmetrical shape comprises a nautilus shape.

24. A microphone assembly arranged in or on a musical instrument, the microphone assembly comprising:

a microphone housing;

a microphone capsule arranged at a first end of the microphone housing; and a baffle statically mounted to the first end of the microphone housing, such that the microphone capsule is arranged within the baffle, wherein the baffle is statically arranged in proximity to a dynamically moveable surface of the musical instrument, and creates a high sound pressure zone between a surface of the baffle and the dynamically moveable surface of the musical instrument, and wherein a diaphragm of the microphone capsule is approximately co-planar with at least a portion of the surface of the baffle surrounding the microphone capsule.

25. The microphone assembly arranged in or on the musical instrument according to claim 24, wherein the surface of the baffle is approximately parallel to the dynamically moveable surface of the musical instrument.

26. The microphone assembly arranged in or on the musical instrument according to claim 24, wherein a distance between the surface of the baffle and a rest-position of the dynamically moveable surface of the musical instrument is adjustable.

27. The microphone assembly arranged in or on the musical instrument according to claim 24, wherein a distance between the surface of the baffle and a rest-position of the dynamically moveable surface of the musical instrument is set between ⅛" and ½".

28. The microphone assembly arranged in or on the musical instrument according to claim 24, wherein the baffle comprises a nautilus shape.

29. The microphone assembly arranged in or on the musical instrument according to claim 24, wherein the musical instrument is one of: a banjo, a guitar, a violin, a viola, a cello, an upright bass, a mandolin-family instrument, a piano, or a drum.

30. The microphone assembly arranged in or on the musical instrument according to claim 24, wherein the microphone assembly is statically arranged internally within the musical instrument.

31. The microphone assembly arranged in or on the musical instrument according to claim 24, wherein the microphone assembly is statically arranged adjacent an external surface of the musical instrument.

32. The microphone assembly arranged in or on the musical instrument according to claim 24, wherein a distance d between the surface of the baffle and a rest-position of the dynamically moveable surface of the musical instrument is $d \leq \frac{1}{2}(R_{min}+R_{max})/2))$, wherein $R_{min}$ is a minimum radial distance of the baffle and $R_{max}$ is a maximum radial distance of the baffle.

33. The microphone assembly arranged in or on the musical instrument according to claim 24, wherein the musical instrument comprises a soundboard for sound production.

* * * * *